US008256503B2

(12) United States Patent
Cox

(10) Patent No.: US 8,256,503 B2
(45) Date of Patent: Sep. 4, 2012

(54) PLASTIC HEAT EXCHANGER WITH EXTRUDED SHELL

(76) Inventor: Richard D. Cox, Novi, MI (US)

( * ) Notice: Subject to any disclaimer, the term of this patent is extended or adjusted under 35 U.S.C. 154(b) by 1083 days.

(21) Appl. No.: 12/218,632

(22) Filed: Jul. 17, 2008

(65) Prior Publication Data

US 2010/0012296 A1 Jan. 21, 2010

(51) Int. Cl.
*F28F 9/26* (2006.01)
*F28D 7/10* (2006.01)

(52) U.S. Cl. ..... 165/143; 165/144; 165/157

(58) Field of Classification Search ..... 165/157, 165/158, 159, 143, 144, 140
See application file for complete search history.

(56) References Cited

U.S. PATENT DOCUMENTS

| | | | | |
|---|---|---|---|---|
| 1,918,601 | A * | 7/1933 | Jacocks et al. | 165/67 |
| 2,041,328 | A * | 5/1936 | Forbes | 165/70 |
| 2,053,780 | A * | 9/1936 | Price et al. | 165/81 |
| 2,155,666 | A * | 4/1939 | Leidig | 165/143 |
| 2,602,648 | A * | 7/1952 | Martel | 165/143 |
| 4,213,640 | A * | 7/1980 | Miles | 285/124.2 |
| 4,266,604 | A | 5/1981 | Sumikawa | |
| 4,295,522 | A | 10/1981 | Frei | |
| 4,323,115 | A | 4/1982 | Stafford | |
| 4,421,160 | A | 12/1983 | Stafford | |
| 4,479,668 | A | 10/1984 | Jacquet | |
| 4,962,810 | A * | 10/1990 | Bond et al. | 165/143 |
| 6,660,198 | B1 | 12/2003 | Fischer | |
| 6,929,060 | B2 | 8/2005 | Heier | |
| 2006/0278379 | A1 * | 12/2006 | Molavi | 165/143 |

FOREIGN PATENT DOCUMENTS

| | | | |
|---|---|---|---|
| EP | 13700 A | * | 8/1980 |
| JP | 2007 132546 | | 5/2007 |
| KR | 100674716 B | | 1/2007 |

* cited by examiner

*Primary Examiner* — Tho V Duong
(74) *Attorney, Agent, or Firm* — Andrew W. Ludy

(57) ABSTRACT

A plastic heat exchanger has a shell with tanks disposed side-by-side. First and last distribution tanks straddle heat transfer tanks. The shell has a plurality of flow gaps, to allow coolant to flow between adjacent tanks. Spacers hold the flow gaps open.

Upper and lower flanges are adhesively attached to the shell. Flange holes align with the tanks. Each flange hole has an annular wall encircling one of the tanks to preclude the shell from expanding.

Upper and lower manifolds are adjacent the flanges, and have chambers disposed side-by-side for each heat transfer tank. Baffles are adapted to be removably received between the chambers to selectively block flow.

A plurality of tubes extends between upper and lower tube headers, comprising a tube bundle, removably received within each of the heat transfer tanks.

A header O-ring is between each header and flange. A seal plate is disposed against each flange. Each seal plate has seal plate holes in alignment with the flange holes, defining a hole pair. Each hole pair has a groove to receive the header O-ring. Each manifold and seal plate has a manifold seal.

The shell, the manifolds, the headers, and the flanges, are constructed of a polymer. The tubes are constructed of metal materials having efficient heat transfer properties.

37 Claims, 20 Drawing Sheets

36
38
40
42
44
46
48
50
52
54
56
58
59

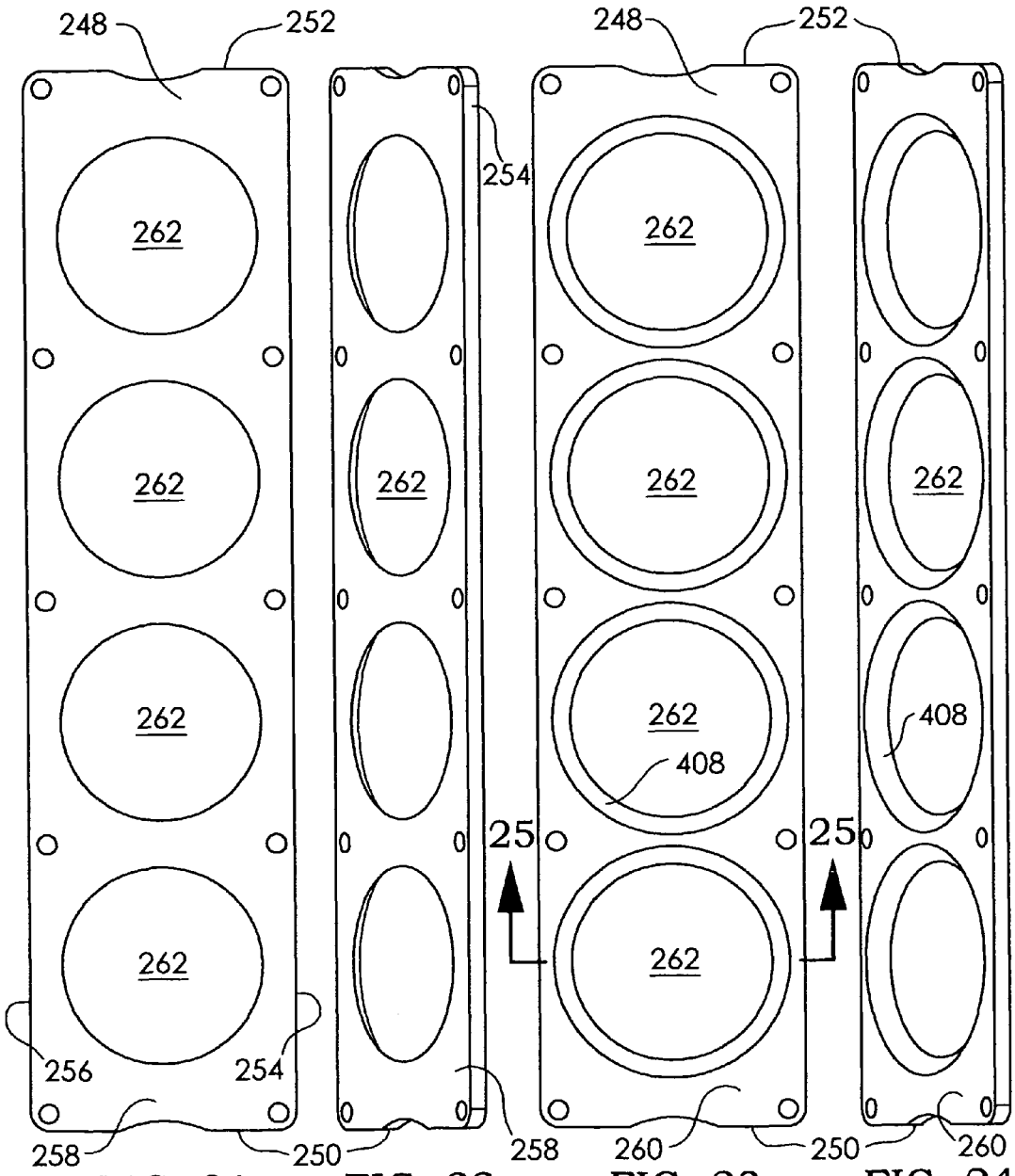
FIG. 21 FIG. 22 FIG. 23 FIG. 24
FIG. 25
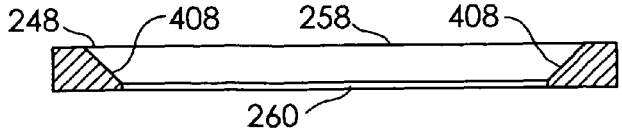

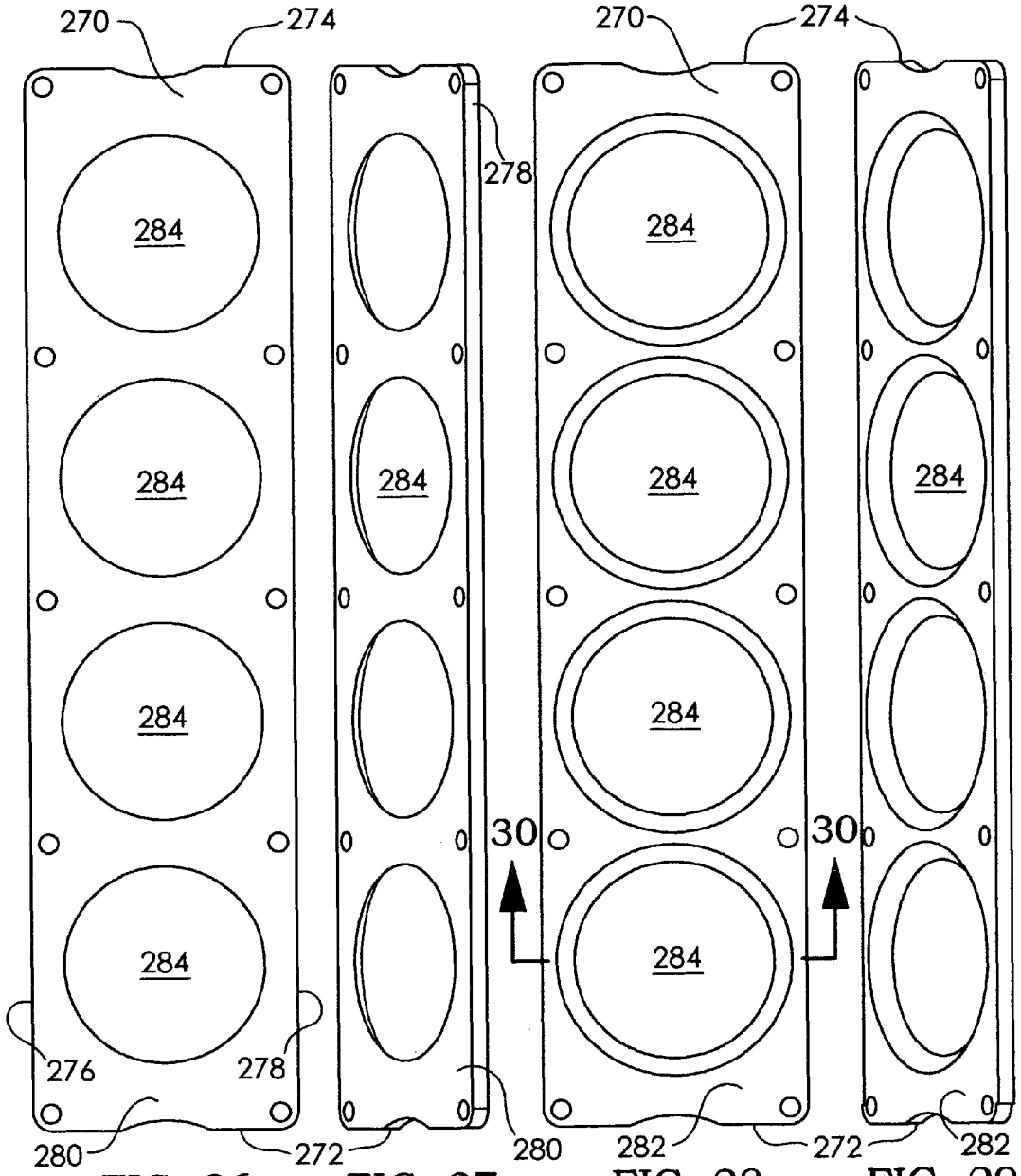
FIG. 26 FIG. 27 FIG. 28 FIG. 29
FIG. 30
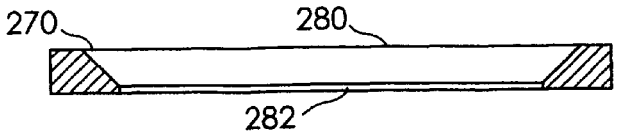

PLASTIC HEAT EXCHANGER WITH EXTRUDED SHELL

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

This invention relates to the field of heat exchangers, and more particularly to a heat exchanger with metal tubes, a plastic main shell extrusion, and plastic manifolds.

In marine applications, a heat exchanger is used to cool the engine. The space available for installation of a heat exchanger is limited, due to engine compartment configurations. Typically, the space is adequate in length fore-and-aft, and in height, but limited in width transversely. Heat exchangers in the prior art are housed in either a circular cylinder or a flat plate box. A circular cylinder of adequate, capacity will not fit into the limited space. The pressure inside the cooling system is about 15 psi. A flat plate of only 12 by 24 inches will develop 4320 lbs of force under 15 psi. A flat-sided box will not withstand the pressure. Other considerations in a marine system are corrosion due to electrolysis, and fouling by marine organisms such as mussels, barnacles, algae, and weeds.

Plastic heat exchangers are known, and have taken a variety of configurations in the past. Some examples of plastic heat exchangers in the art are found in these patents:

Heier, U.S. Pat. No. 6,929,060; shows metal tubes mounted into a plastic manifold. The enclosure is flat-sided.

Stafford, U.S. Pat. No. 4,323,115; discloses a shell and tube heat exchanger with metal tubes set into plastic sheets. The enclosure is cylindrical.

Baker, U.S. Pat. No. 3,363,680; illustrates a shell and tube heat exchanger with plastic tubes. The enclosure is cylindrical.

Humpolik, U.S. Pat. No. 4,576,223; shows metal tubes mounted into a plastic sheet and plastic manifold. The enclosure is flat-sided.

Accordingly, there is a need to provide a heat exchanger that can provide significant capacity within a limited width space.

There is a further need to provide a heat exchanger of the type described and that can withstand at least fifteen pounds per square inch internal pressure.

There is a yet further need to provide a heat exchanger of the type described and that will resist electrolytic corrosion in a salt-water environment.

There is a still further need to provide a heat exchanger of the type described and that will resist the growth of marine organisms.

There is another need to provide a heat exchanger of the type described and that can be manufactured cost-effectively in large quantities of high quality.

BRIEF SUMMARY OF THE INVENTION

In accordance with the present invention, there is provided a plastic heat exchanger 30 is for transferring heat between a primary fluid coolant 32 and a secondary fluid coolant 34. The plastic heat exchanger 30 comprises a shell 36 with a plurality of tanks 42 disposed side-by-side. The first tank is a first distribution tank 44. The last tank is a last distribution tank 46. Intermediate the first and last tanks are heat transfer tanks 48, which are each attached to adjacent tanks 42 along opposite front 50 and rear 52 webs. The shell 36 has a plurality of flow gaps 58, to allow the primary fluid coolant 32 to flow from each tank to the adjacent tank. Each flow gap 58 is disposed between front 50 and rear 52 webs. The tanks 42 each communicate with adjacent tanks 42 through the flow gaps 58. The distribution tanks 44 and 46 are connected to the primary fluid coolant 32.

A plurality of spacers 59 is disposed in each flow gap 58 between a respective front 50 and rear 52 web to maintain the flow gaps 58 in an open condition.

An upper flange 60 is sealingly attached to the shell upper end 38 with an adhesive. The upper flange 60 has a plurality of flange holes 74, each in alignment with one of the tanks 42. Each flange hole 74 has an annular wall 76 adapted to encircle one of the tanks 42 to preclude the shell 36 from expanding outward under internal pressure.

A lower flange 96 is sealingly attached to the shell lower end 38 with an adhesive. The lower flange 96 has a plurality of flange holes 110, each in alignment with one of the tanks. Each flange hole 110 has an annular wall 112 adapted to encircle one of the tanks 42 to preclude the shell 36 from expanding outward.

An upper manifold 134 is disposed adjacent the upper flange 60. The upper manifold 134 has a plurality of chambers 152 disposed side-by-side. Each chamber 152 corresponds to a respective heat transfer tank 48. Each chamber 152 is in communication with the adjacent chamber 152. Each chamber 152 is separated from the adjacent chamber 152 by opposed front 154 and rear 156 channels. The upper manifold 134 is connected to the secondary fluid coolant 34.

A lower manifold 178 is disposed adjacent the lower flange 96. The lower manifold 178 has a plurality of chambers 196 disposed side-by-side. Each chamber 196 corresponds to a respective heat transfer tank 48. Each chamber 196 is in communication with the adjacent chamber 196. Each chamber 196 is separated from the adjacent chamber 196 by opposed front 198 and rear 200 channels. The lower manifold 178 is connected to the secondary fluid coolant 34.

At least one baffle 246 is adapted to be removably received in a pair of the opposed front 154 and rear 156 channels of the upper manifold 134, and in a pair of the opposed front 198 and rear 200 channels of the lower manifold 178. The baffles 246 are used to selectively block communication between the respective adjacent chambers 152 of the upper manifold 134, and between the respective adjacent chambers 196 of the lower manifold 178. A plurality of baffles 246 can be installed in selected channels in the upper 134 and lower 178 manifolds, to direct the flow of secondary fluid coolant 34.

An upper tube header 222 and a lower tube header 226 are provided. A plurality of generally straight and parallel tubes 230 extend between the upper 222 and lower 226 tube headers, and comprise a tube bundle 242. Each tube bundle 242 is removably received within one of the heat transfer tanks 48.

A header sealing means, header O-ring 244 is juxtaposed between each header 222 and 226, and the respective flange. An upper seal plate 248 is disposed against the upper flange 60. The upper seal plate 248 has an upper seal plate hole 262 for each heat transfer tank 48. Each upper seal plate hole 262 is juxtaposed in collinear alignment with one of the upper flange holes 74, defining an upper hole pair 264. Each upper hole pair 264 has at least one upper annular recess 266, forming an upper header O-ring groove 268 to receive the header O-ring 244. A manifold sealing means, upper seal 292 is juxtaposed between the upper manifold 134 and the upper seal plate 248.

A lower seal plate 270 is disposed against the lower flange 96. The lower seal plate 270 has a lower seal plate hole 284 for each heat transfer tank 48. Each lower seal plate hole 284 is juxtaposed in collinear alignment with one of the lower flange holes 74, defining a lower hole pair 286. Each lower hole pair 286 has at least one lower annular recess 288, forming a lower header O-ring groove 290 to receive the header O-ring 244. A lower seal 294 is juxtaposed between the lower manifold 178 and the lower seal plate 270.

The distribution tanks 44 and 46 are connected to the primary fluid coolant 32 by first 298 and second 312 flange connectors. A flange connector O-ring 296 is provided for rotatably sealing the first 298 and second 312 flange connectors to the flanges 60 and 96.

Two flange plugs 330 are provided to selectively block the flow of primary fluid coolant 32 a flange plug O-ring 340 is provided for sealing the flange plugs 330 to the flanges 60 and 96.

The upper 134 and lower 178 manifolds are connected to the secondary fluid coolant 34 by first 346 and second 360 manifold connectors. A manifold connector O-ring 374 is provided for rotatably sealing the first 346 and second 360 manifold connectors to the manifolds 134 and 178.

Two manifold plugs 380 are provided to selectively block the flow of secondary fluid coolant 34. A manifold plug O-ring 390 is provided for sealing the manifold plugs 380 to the manifolds 134 and 178.

The shell 36, manifolds 134 and 178, headers 222 and 226, and the flanges 60 and 96, are constructed of a non-metallic corrosion resistant polymeric material. The tubes 230 are constructed of metal materials having efficient heat transfer properties.

BRIEF DESCRIPTION OF THE SEVERAL VIEWS OF THE DRAWING

A more complete understanding of the present invention may be obtained from consideration of the following description in conjunction with the drawing, in which:

FIG. 21 is a top plan view of the upper seal plate of the plastic heat exchanger of FIG. 1.

FIG. 22 is a top perspective view of the upper seal plate of the plastic heat exchanger of FIG. 1.

FIG. 23 is a bottom view of the upper seal plate of the plastic heat exchanger of FIG. 1.

FIG. 24 is a bottom perspective view of the upper seal plate of the plastic heat exchanger of FIG. 1.

FIG. 25 is a cross-sectional, elevational view of the upper seal plate of the plastic heat exchanger of FIG. 1, taken along lines 25-25 of FIG. 23.

FIG. 26 is a top plan view of the lower seal plate of the plastic heat exchanger of FIG. 1.

FIG. 27 is a top perspective view of the lower seal plate of the plastic heat exchanger of FIG. 1.

FIG. 28 is a bottom view of the lower seal plate of the plastic heat exchanger of FIG. 1.

FIG. 29 is a bottom perspective view of the lower seal plate of the plastic heat exchanger of FIG. 1.

FIG. 30 is a cross-sectional, elevational view of the lower seal plate of the plastic heat exchanger of FIG. 1, taken along lines 30-30 of FIG. 28.

DETAILED DESCRIPTION OF THE INVENTION

Figure 1:
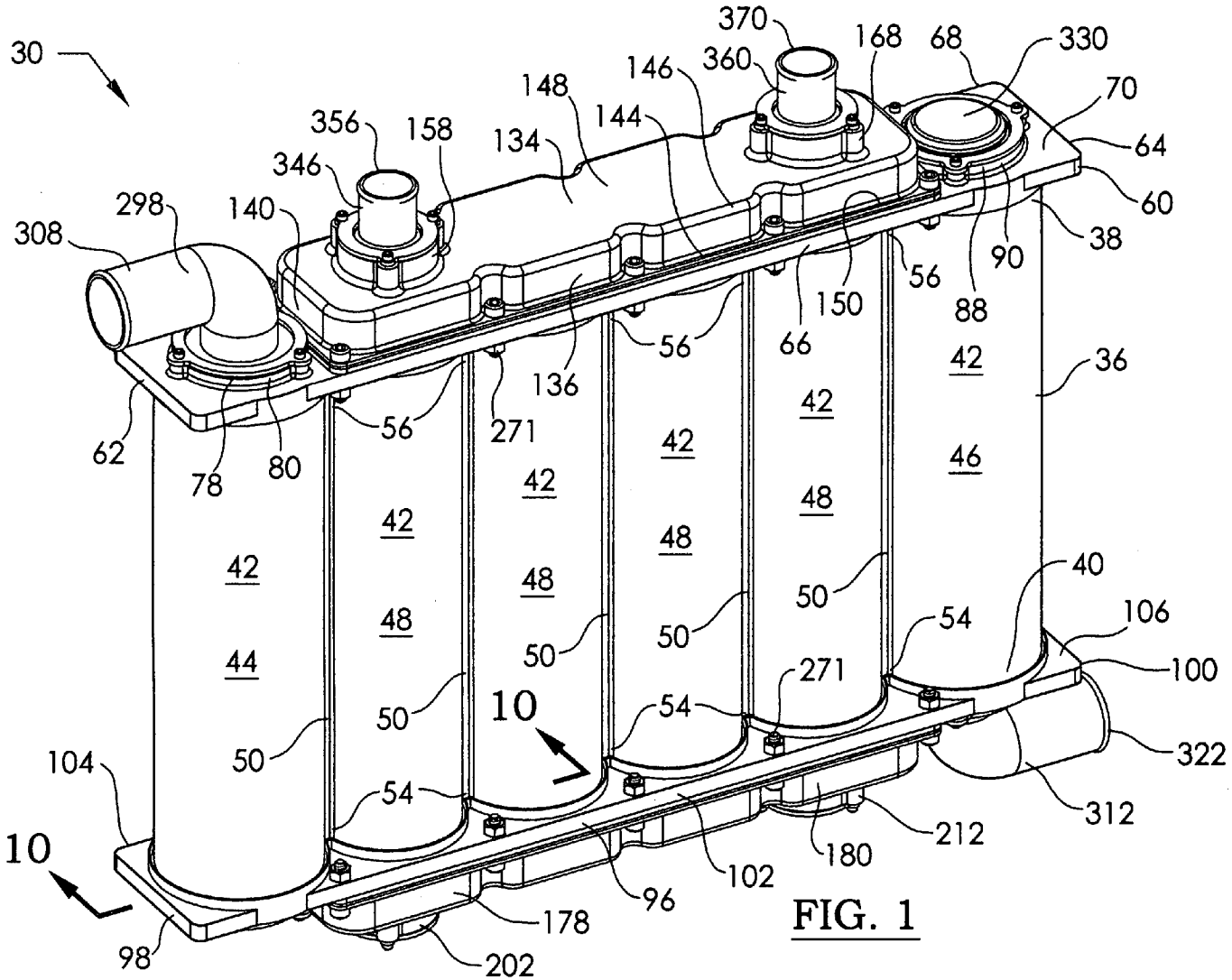
FIG. 1 is a perspective view of a plastic heat exchanger constructed in accordance with the invention.
Figure 2:
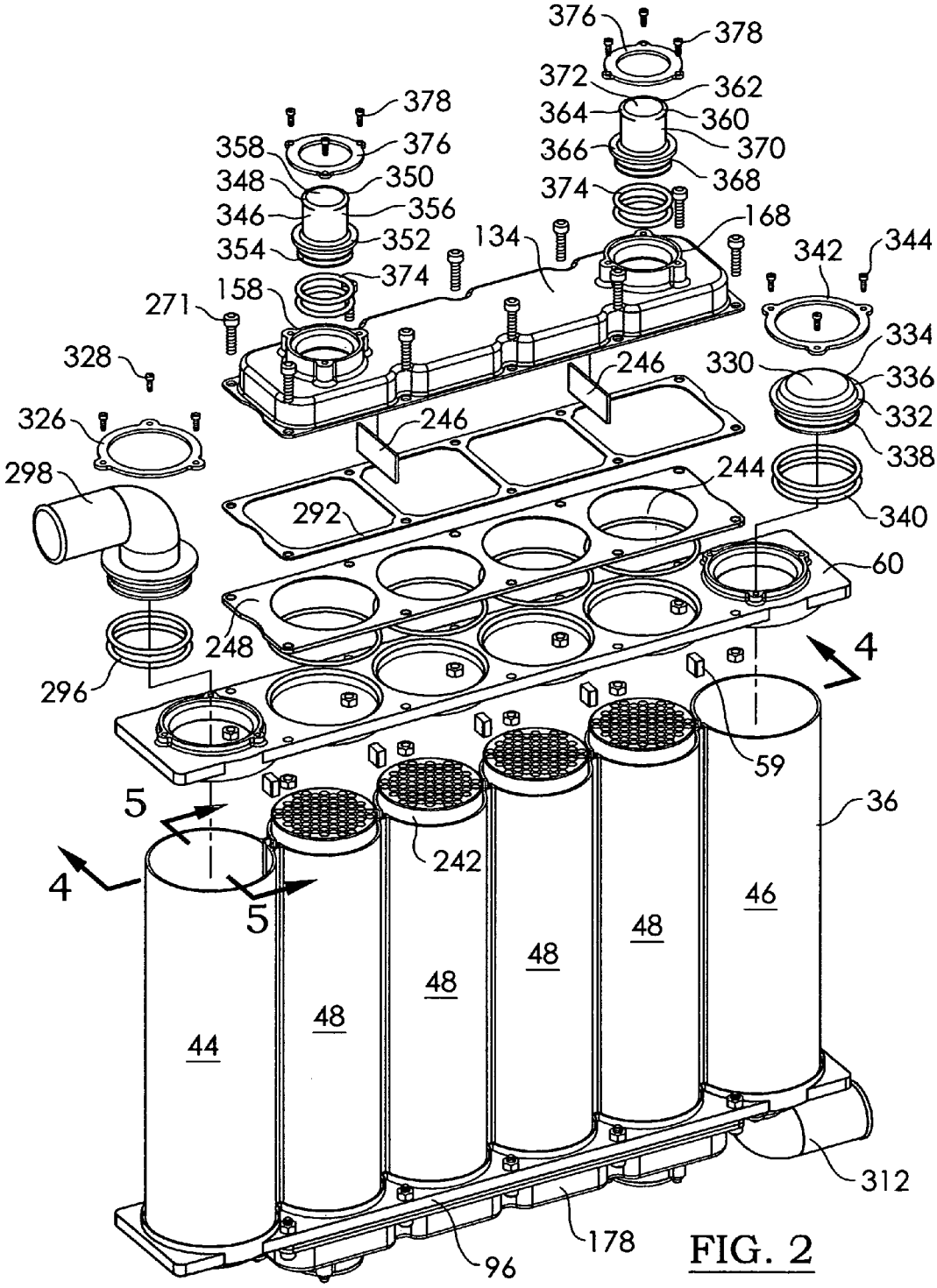
FIG. 2 is an exploded, assembly, perspective view of the plastic heat exchanger of FIG. 1, showing the upper components exploded.
Figure 3:
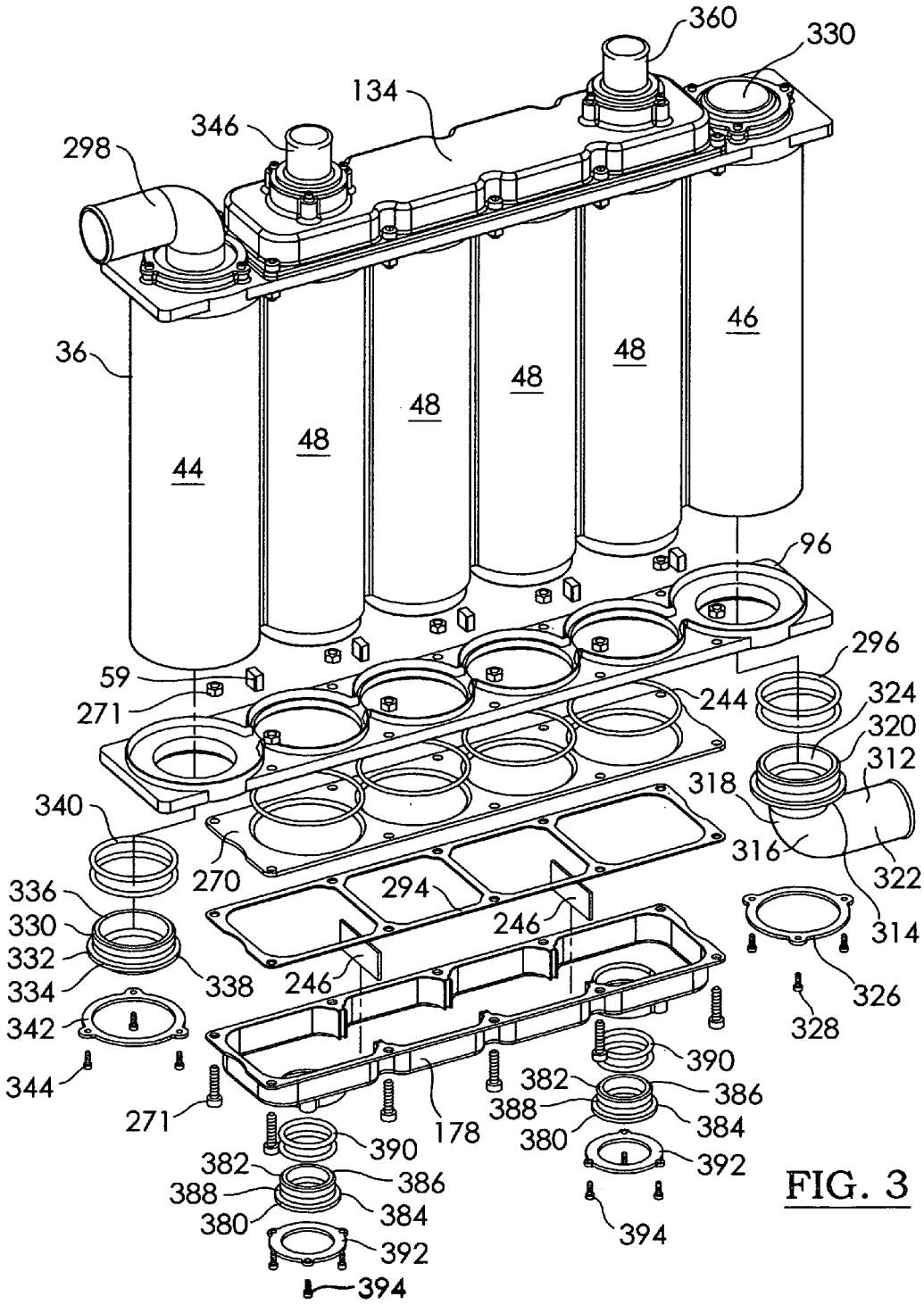
FIG. 3 is an exploded, assembly, perspective view of the plastic heat exchanger of FIG. 1, showing the lower components exploded.

Referring now to the drawing, and especially to FIGS. 1-11 thereof, a plastic heat exchanger is shown at 30. The plastic heat exchanger 30 is for transferring heat between a primary fluid coolant 32 and a secondary fluid coolant 34. The coolants are supplied by a primary fluid coolant system and a secondary fluid coolant system respectively. The coolants are carried by external conduits (not shown). The plastic heat exchanger 30 comprises a shell 36 extending between opposite upper 38 and lower 40 ends. The shell 36 has a plurality of tanks 42, each having a cylindrical cross-section. The tanks are disposed side-by-side in an array that can be a linear or a zigzag pattern. The first tank in the array is a first distribution tank 44. The last tank in the array is a last distribution tank 46. The tanks intermediate the first and last tanks are heat transfer tanks 48. The tanks 42 are each attached to adjacent tanks 42 along opposite front 50 and rear 52 webs. The front 50 and rear 52 webs extend from a lower end 54 adjacent the shell lower end 40 to an upper end 56 adjacent the shell upper end 38. The shell 36 has a plurality of flow gaps 58, to allow the primary fluid coolant 32 to flow from each tank to the adjacent tank, as shown in FIGS. 35-38. Each flow gap 58 is disposed between a respective front 50 and rear 52 web. The tanks 42 are each in communication with adjacent tanks 42 through the flow gaps 58. The distribution tanks 44 and 46 are connected to the primary fluid coolant system.

Figures 4, 5A, 5B, 6:
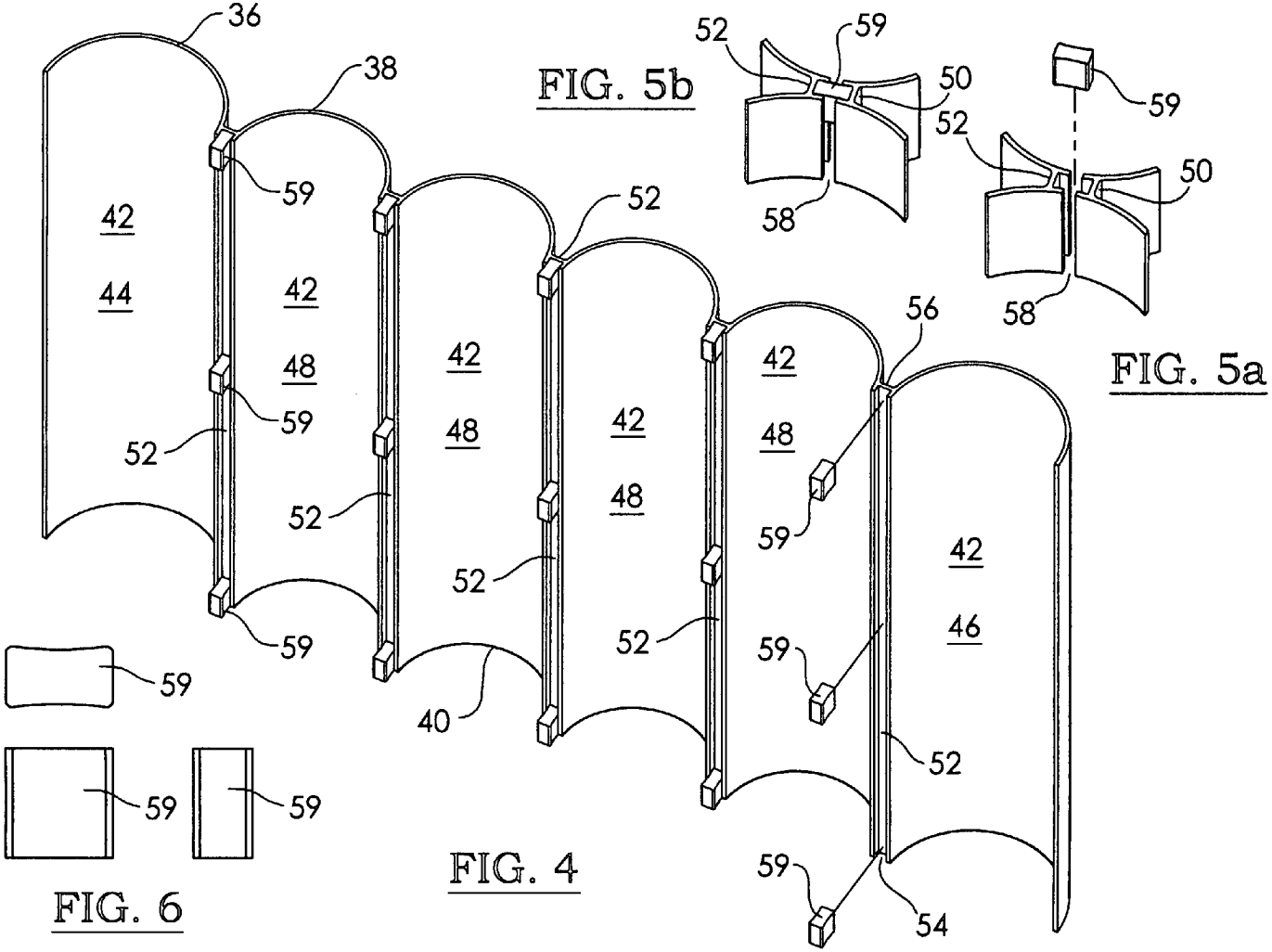
FIG. 4 is a cross-sectional, elevational, perspective view of the shell of the plastic heat exchanger of FIG. 1, taken along lines 4-4 of FIG. 2, and showing the spacers installed in the flow gaps.
FIG. 5*a* is a partial, cross-sectional, elevational, perspective view of the plastic heat exchanger of FIG. 1, showing a flow gap and spacer exploded, taken along lines 5-5 of FIG. 2.
FIG. 5*b* is a partial, cross-sectional, elevational, perspective view of the plastic heat exchanger of FIG. 1, showing a flow gap and spacer installed, taken along lines 5-5 of FIG. 2.
FIG. 6 shows front and right side elevational views and a top plan view of the spacer of the plastic heat exchanger of FIG. 1.
Figure 7:
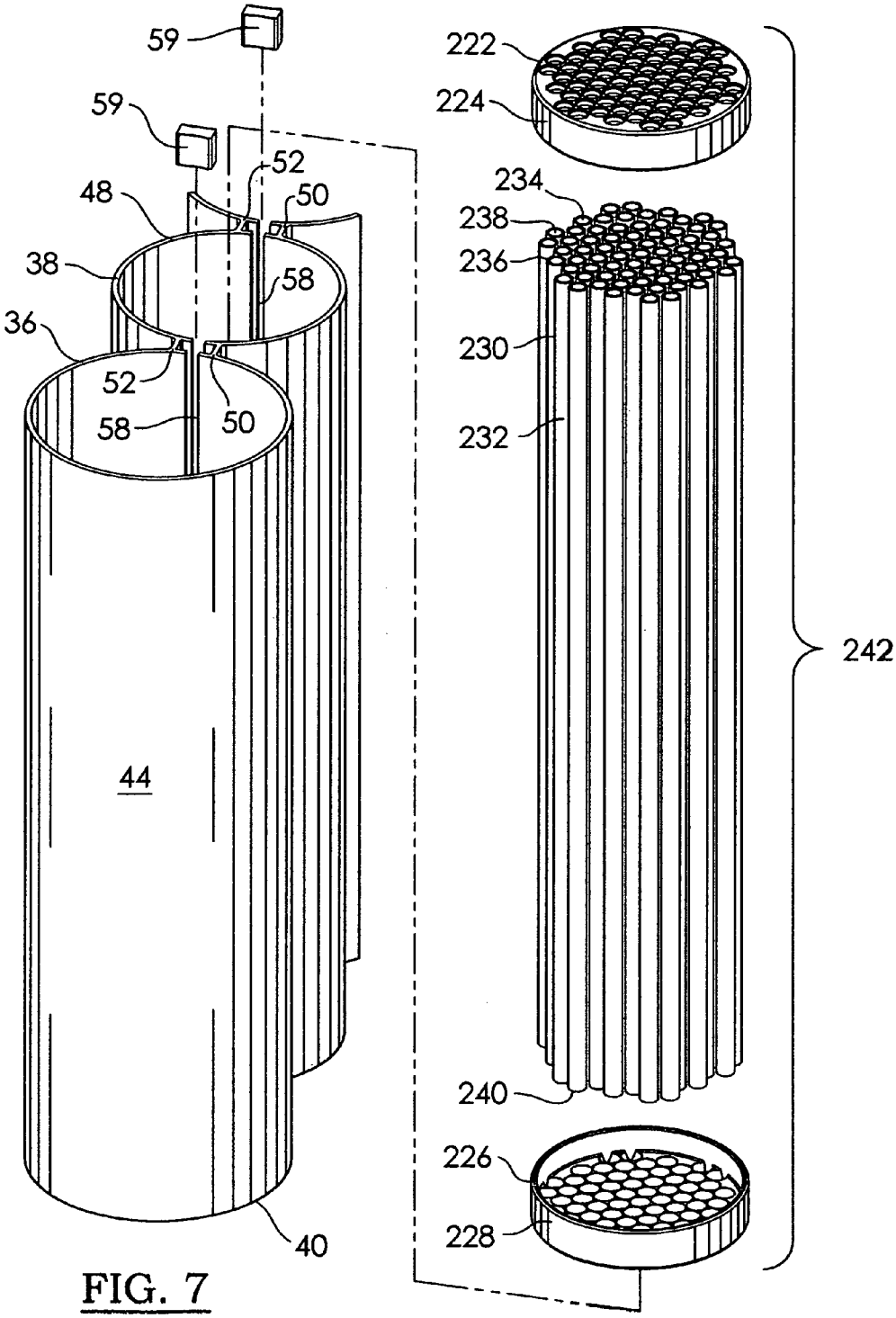
FIG. 7 is a partial, elevational, perspective view of the shell, and the tube bundle of the plastic heat exchanger of FIG. 1, showing the tubes and headers exploded.

A plurality of spacers 59 is disposed in each flow gap 58 between a respective front 50 and rear 52 web adjacent the web upper 56 and lower 54 ends. Additional spacers 59 can be inserted intermediate the web upper 56 and lower 54 ends, as shown in FIGS. 4-6. The spacers 59 will maintain the flow gaps 58 in an open condition to assure unimpeded flow of the primary fluid coolant 32.

An upper flange 60 is sealingly attached to the shell upper end 38 with an adhesive. The upper flange 60 extends between opposite first 62 and second 64 ends, and between opposite front 66 and rear 68 edges. The upper flange 60 has an outer surface 70 facing away from the shell 36 and an inner surface 72 facing toward the shell 36. The upper flange 60 has a plurality of flange holes 74. Each flange hole 74 is in alignment with one of the tanks 42 and extends through the upper flange 60 from the outer surface 70 to the inner surface 72. Each flange hole 74 has an annular wall 76 extending away from the inner surface 72. Each upper flange annular wall 76 is adapted to encircle one of the tanks 42 at the shell upper end 38. This will preclude the shell 36 from expanding outward under internal pressure. The upper flange 60 has an upper flange first receiver 78 adjacent the upper flange first end 62, and an upper flange last receiver 88 adjacent the upper flange second end 64. The upper flange first 78 and last 88 receivers are unitary, or one-piece, with the upper flange. The upper flange first receiver 78 has a central axis, and a boss 80 extending between a proximal end 82 at the flange outer surface 70 and a distal end 84. The upper flange first receiver 78 has a circular bore 86 passing through the boss 80 and is in communication with the first distribution tank 44. The upper flange last receiver 88 has a central axis, and a boss 90 extending between a proximal end 92 at the flange outer surface 70 and a distal end 94. The upper flange last receiver 88 has a circular bore 95 passing through the boss 90 and in is communication with the last distribution tank 46.

A lower flange 96 is sealingly attached to the shell lower end 38 with an adhesive. The lower flange 96 extends between opposite first 98 and second 100 ends, and between opposite front 102 and rear 104 edges. The lower flange 96 has an outer surface 106 facing away from the shell 36 and an inner surface 108 facing toward the shell 36. The lower flange 96 has a plurality of flange holes 110. Each flange hole 110 is in alignment with one of the tanks 42 and extends through the lower flange 96 From the outer surface 106 to the inner surface 108. Each flange hole 110 has an annular wall 112 extending away from the inner surface 108. Each lower flange annular wall 112 is adapted to encircle one of the tanks 42 at the shell lower end 38. This will preclude the shell 36 from expanding outward under internal pressure. The lower flange 96 has a lower flange first receiver 114 adjacent the lower flange first end 98, and a lower flange last receiver 124 adjacent the lower flange second end 100. The lower flange first 114 and last 124 receivers are unitary, or one-piece, with the lower flange 96. The lower flange first receiver 114 has a central axis, and a boss 116 extending between a proximal end 118 at the flange outer surface 106 and a distal end 120. The lower flange first receiver 114 has a circular bore 122 passing through the boss 116 and is in communication with the first distribution tank 44. The lower flange last receiver 124 has a central axis, and a boss 126 extending between a proximal end 128 at the flange outer surface 106 and a distal end 130. The lower flange last receiver 124 has a circular bore 132 passing through the boss 126 and is in communication with the last distribution tank 46.

An upper manifold 134 is disposed adjacent the upper flange 60. The upper manifold 134 has a front wall 136, a rear wall 138, a first end wall 140, and a second end wall 142. The walls extend between inner 144 and outer 146 edges. The upper manifold 134 has an outer plate 148 extending between the front 136 and rear 138 walls and between the first 140 and second 142 end walls along the outer edges 146 of the walls. The upper manifold 134 has a rim 150 extending around the inner edges 144 of the walls. The upper manifold 134 has a plurality of chambers 152 enclosed within the front 136 and rear 138 walls, the first 140 and second 142 end walls, and the outer plate 148. The chambers 152 are disposed side-by-side in an array that corresponds with the tank array. Each chamber 152 corresponds to a respective heat transfer tank 48. Each chamber 152 is in communication with the adjacent chamber 152. Each chamber 152 is separated from the adjacent chamber 152 by opposed front 154 and rear 156 channels. Each front channel 154 extends along the front wall 136 between the inner 144 and outer 146 edges. Each rear channel 156 extends along the rear wall 138 between the inner 144 and outer 146 edges. The upper manifold 134 is connected to the secondary fluid coolant system, so as to convey the secondary fluid coolant 34 between the secondary fluid coolant system and the heat transfer tanks 48. The upper manifold 134 has an upper manifold first receiver 158 adjacent the first end wall 140, and an upper manifold last receiver 168 adjacent the second end wall 142. The upper manifold first 158 and last 168 receivers are unitary, or one-piece, with the upper manifold 134. The upper manifold first receiver 158 has a central axis, and a boss 160 extending between a proximal end 162 at the upper manifold outer plate 148 and a distal end 164. The upper manifold first receiver 158 has a circular bore 166 passing through the boss 160 and in communication with one of the chambers 152, namely the first chamber in the array. The upper manifold last receiver 168 has a central axis, and a boss 170 extending between a proximal end 172 at the upper manifold outer plate 148 and a distal end 174. The upper manifold last receiver 168 has a circular bore 176 passing through the boss 170 and in communication with one of the chambers 152, namely the last chamber in the array.

A lower manifold 178 is disposed adjacent the lower flange 96. The lower manifold 178 has a front wall 180, a rear wall 182, a first end wall 184, and a second end wall 186. The walls extend between inner 188 and outer 190 edges. The lower manifold 178 has an outer plate 192 extending between the front 180 and rear 182 walls and between the first 184 and second 186 end walls along the outer edges 190 of the walls. The lower manifold 178 has a rim 194 extending around the inner edges 188 of the walls. The lower manifold 178 has a plurality of chambers 196 enclosed within the front 180 and rear 182 walls, the first 184 and second 186 end walls, and the outer plate 192. The chambers 196 are disposed side-by-side in an array that corresponds with the tank array. Each chamber 196 corresponds to a respective heat transfer tank 48. Each chamber 196 is in communication with the adjacent chamber 196. Each chamber 196 is separated from the adjacent chamber 196 by opposed front 198 and rear 200 channels. Each front channel 198 extends along the front wall 180 between the inner 188 and outer 190 edges. Each rear channel 200 extends along the rear wall 182 between the inner 188 and outer 190 edges. The lower manifold 178 is connected to the secondary fluid coolant system, so as to convey the secondary fluid coolant 34 between the secondary fluid coolant system and the heat transfer tanks 48. The lower manifold 178 has a lower manifold first receiver 202 adjacent the first end wall 184, and a lower manifold last receiver 212 adjacent the second end wall 186. The lower manifold first 202 and last 212 receivers are unitary, or one-piece, with the lower manifold 178. The lower manifold first receiver 202 has a central axis, and a boss 204 extending between a proximal end 206 at the lower manifold outer plate 192 and a distal end 208. The lower manifold first receiver 202 has a circular bore 210 passing through the boss 204 and in communication with one of the chambers 196, namely the first chamber in the array. The lower manifold last receiver 212 has a central axis, and a boss 214 extending between a proximal end 216 at the lower manifold outer plate 192 and a distal end 218. The lower manifold last receiver 212 has a circular bore 220 passing through the boss 214 and in communication with one of the chambers 196, namely the last chamber in the array.

At least one baffle 246 is adapted to be removably received in a pair of the opposed front 154 and rear 156 channels of the upper manifold 134. At least one baffle 246 is adapted to be removably received in a pair of the opposed front 198 and rear 200 channels of the lower manifold 178. The baffles 246 are used to selectively block communication between the respective adjacent chambers 152 of the upper manifold 134, and between the respective adjacent chambers 196 of the lower manifold 178. A plurality of baffles 246 can be installed in selected channels in the upper 134 and lower 178 manifolds, to direct the flow of secondary fluid coolant 34. The flow paths of the secondary fluid coolant 34 can be selected to control the heat transfer characteristics of the plastic heat exchanger. Some sample flow patterns are shown in FIGS. 35-38, although many other optional paths are possible.

An upper tube header 222 is provided, and has an outer periphery 224. A lower tube header 226 is provided, and has an outer periphery 228. The upper 222 and lower 226 tube headers are spaced apart and generally parallel.

A plurality of generally straight and parallel tubes 230 extend between the upper 222 and lower 226 tube headers. The tubes 230 each have an outer surface 232 and a bore 234. The tubes 230 each have a tube wall 236 extending between the outer surface 232 and the bore 234. The tubes 230 each have upper 238 and lower 240 open ends attached to and penetrating the upper 222 and lower 226 tube headers, respectively.

The plastic heat exchanger 30 has a plurality of tube bundles 242, wherein the upper tube header 222, the lower tube header 226, and the tubes 250, comprise a tube bundle 242. Each tube bundle 242 is removably received within one of the heat transfer tanks 48. The upper tube header 222 of the tube bundle 242 is juxtaposed with the upper flange 60, and the lower tube header 226 is juxtaposed with the lower flange 96.

A header sealing means, header O-ring 244 is juxtaposed between each header 222 and 226, and the respective flange, for sealing the upper 222 and lower 226 tube headers against leakage. Any number of configurations of the O-ring installation is possible. In the preferred embodiment, an upper seal plate 248 is disposed against the upper flange outer surface 70. The upper seal plate 248 extends between opposite first 250 and second 252 ends, and between opposite front 254 and rear 256 edges. The upper seal plate 248 has an outer surface 258 facing away from the shell 36, and an inner surface 260 facing toward the shell 36. The upper seal plate 248 has an upper seal plate hole 262 for each heat transfer tank 48. Each upper seal plate hole 262 extends through the upper seal plate 248 from the outer surface 258 to the inner surface 260. Each upper seal plate hole 262 is juxtaposed in collinear alignment with one of the upper flange holes 74, defining an upper hole pair 264. Each upper hole pair 264 has at least one upper annular recess 266. Each upper hole pair 264 receives one of the upper tube headers 222 inserted into the hole pair 264. The upper tube header outer periphery 224 and the respective hole pair annular recess 266 defines an upper header O-ring groove 268. The header O-ring 244 is received in the upper header O-ring groove 268.

A lower seal plate 270 is disposed against the lower flange outer surface 106. The lower seal plate 270 extends between opposite first 272 and second 274 ends, and between opposite front 276 and rear 278 edges. The lower seal plate 270 has an outer surface 280 facing away from the shell 36, and an inner surface 282 facing toward the shell 36. The lower seal plate 270 has a lower seal plate hole 284 for each heat transfer tank 48. Each lower seal plate hole 284 extends through the lower seal plate 270 from the outer surface 280 to the inner surface 282. Each lower seal plate hole 284 is juxtaposed in collinear alignment with one of the lower flange holes 74, defining a lower hole pair 286. Each lower hole pair 286 has at least one lower annular recess 288. Each lower hole pair 286 receives one of the lower tube headers 226 inserted into the hole pair 286. The lower tube header outer periphery 228 and the respective hole pair annular recess 288 defines a lower header O-ring groove 290. The header O-ring 244 is received in the lower header O-ring groove 290.

A manifold sealing means, upper seal 292 extends around the upper manifold rim and is juxtaposed between the upper manifold rim 150 and the upper flange 60 for sealing the upper manifold 134 against leakage. Specifically, the upper seal is a gasket 292 or an O-ring (not shown). The upper seal 292 is disposed directly against the upper manifold rim 150 and the upper seal plate 248.

A lower seal 294 extends around the lower manifold rim 194 and is juxtaposed between the lower manifold rim 194 and the lower flange 96 for sealing the lower manifold 178 against leakage. Specifically, the lower seal is a gasket 294 or an O-ring (not shown). The lower seal 294 is disposed directly against the lower manifold rim 194 and the lower seal plate 270.

The upper 134 and lower 178 manifolds, and the upper 248 and lower 270 seal plates are secured to the upper and lower flanges by threaded fasteners 271.

The distribution tanks 44 and 46 are connected to the primary fluid coolant system by first 298 and second 312 flange connectors. The first flange connector 298 has a central axis and a body 300 extending between upper 302 and lower 304 ends. The body lower end 304 has a pilot 306. The body upper end 302 has a nozzle 308. The nozzle 308 has an axis at an angle to the connector central axis of between zero and ninety degrees. The first flange connector pilot 306 is removably and rotatably received within any one of the upper and lower flange receiver bores 86, 95, 122, and 132. Typically, the first flange connector 298 will be installed in the upper flange first receiver circular bore 86, as shown in FIGS. 1, 2, 3, 35, 36, 37, and 38. The first flange connector 298 has a circular bore 310 passing through the body 300 and in communication with the respective flange receiver bore.

The second flange connector 312 has a central axis and a body 314 extending between upper 316 and lower 318 ends. The body lower end 318 has a pilot 320. The body upper end 316 has a nozzle 322. The nozzle 322 has an axis at an angle to the connector central axis of between zero and ninety degrees. The second flange connector pilot 320 is removably and rotatably received within any one of the upper and lower flange receiver bores 86, 95, 122, and 132. Typically, the second flange connector 312 will be installed in the lower flange last receiver circular bore 132, as shown in FIGS. 1, 2, 3, 35, 36, and 37. Alternatively, the second flange connector 312 can be installed in another receiver, such as the upper flange last receiver circular bore 95, as shown in FIG. 38. The second flange connector 312 has a circular bore 324 passing through the body 314 and in communication with the respective flange receiver bore.

Figure 8:
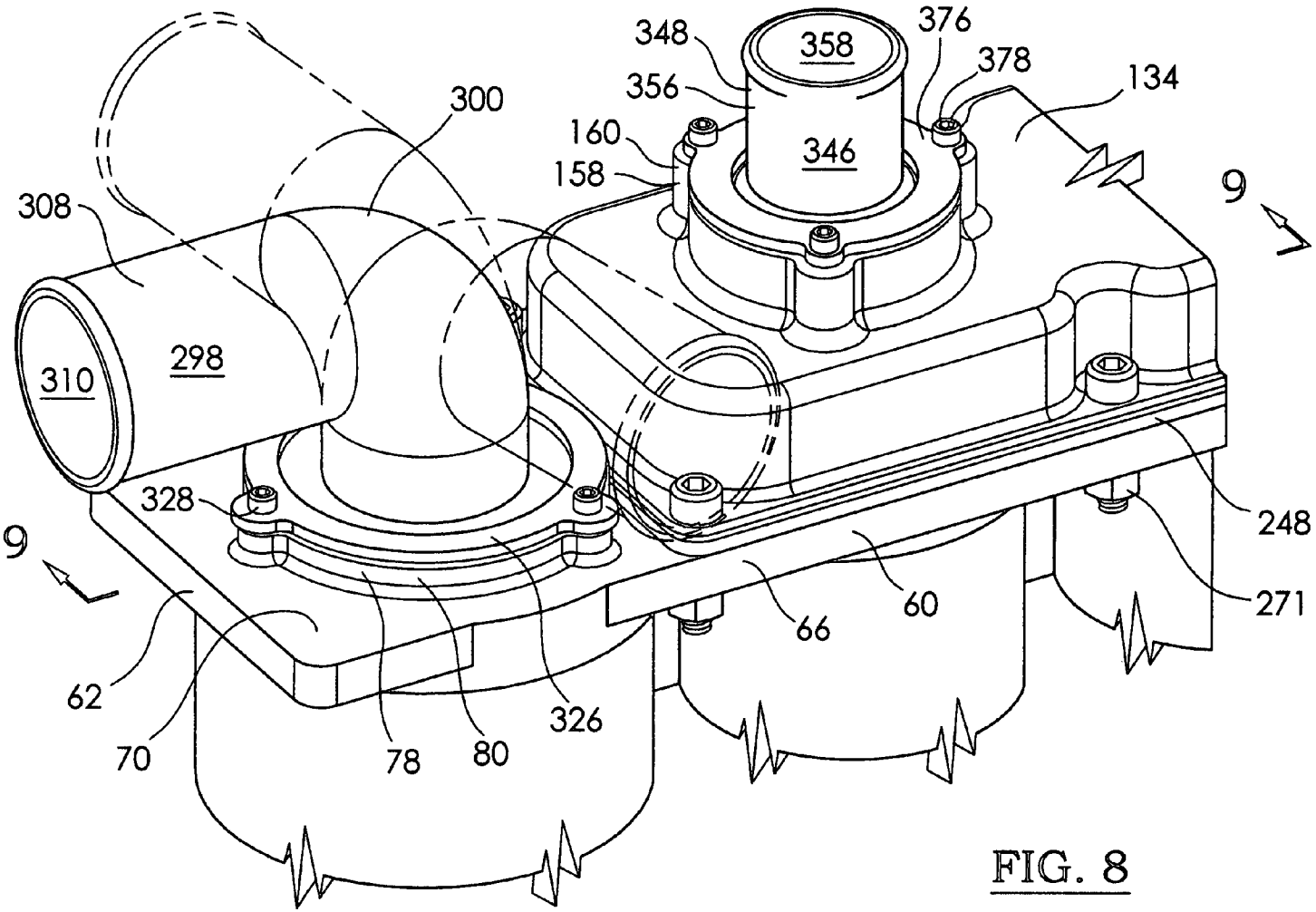
FIG. 8 is a partial, perspective, enlarged view of the plastic heat exchanger of FIG. 1, showing the flange and manifold connectors rotatably received in the flange and manifold receivers, respectively.

Flange connector sealing means is provided for rotatably sealing the first 298 and second 312 flange connectors to the flange receivers. This allows connection of the nozzles 308 and 322 to the external conduits in any orientation, as shown in FIG. 8. Specifically, a flange connector O-ring 296 is sealingly juxtaposed between each one of the flange connector pilots 306 and 320 and the respective one of the flange receiver bores 86, 95, 122, and 132.

Retaining means is provided for retaining the flange connector pilot in the receiver bore, while allowing selective rotation of the connector about the connector central axis. Specifically, the retaining means is a flange connector retainer 326 secured by threaded fasteners 328.

Two flange plugs 330 are provided to selectively block the flow of primary fluid coolant 32. Each flange plug 330 has a central axis and a body 332 extending between upper 334 and lower 336 ends. The body lower end 336 has a pilot 338. Each flange plug pilot 338 is adapted to be removably received within one of the upper and lower flange receiver bores 86, 95, 122, and 132.

Flange plug sealing means is provided for sealing the flange plugs 330 to the flange receivers. Specifically, a flange plug O-ring 340 is sealingly juxtaposed between each one of the flange plug pilots 338 and the respective one of the flange receiver bores 86, 95, 122, and 132.

Retaining means is provided for retaining the flange plug pilot in the receiver bore. Specifically, the retaining means is a flange plug retainer 342 secured by threaded fasteners 344.

The upper 134 and lower 178 manifolds are connected to the secondary fluid coolant system by first 346 and second 360 manifold connectors. The first manifold connector 346 has a central axis and a body 348 extending between upper 350 and lower 352 ends. The body lower end 352 has a pilot 354. The body upper end 350 has a nozzle 356. The nozzle 356 has an axis at an angle to the connector central axis of between zero and ninety degrees. The first manifold connector pilot 354 is removably and rotatably received within any one of the upper and lower manifold receiver bores 166, 176, 216, and 220. Typically, the first manifold connector 346 is installed in the upper manifold first receiver bore 166, as shown in FIGS. 1, 2, 3, 35, 36, 37, and 38. The first manifold connector 346 has a circular bore 358 passing through the body 348 and in communication with the respective manifold receiver bore 166, 176, 216, and 220.

Figure 35:
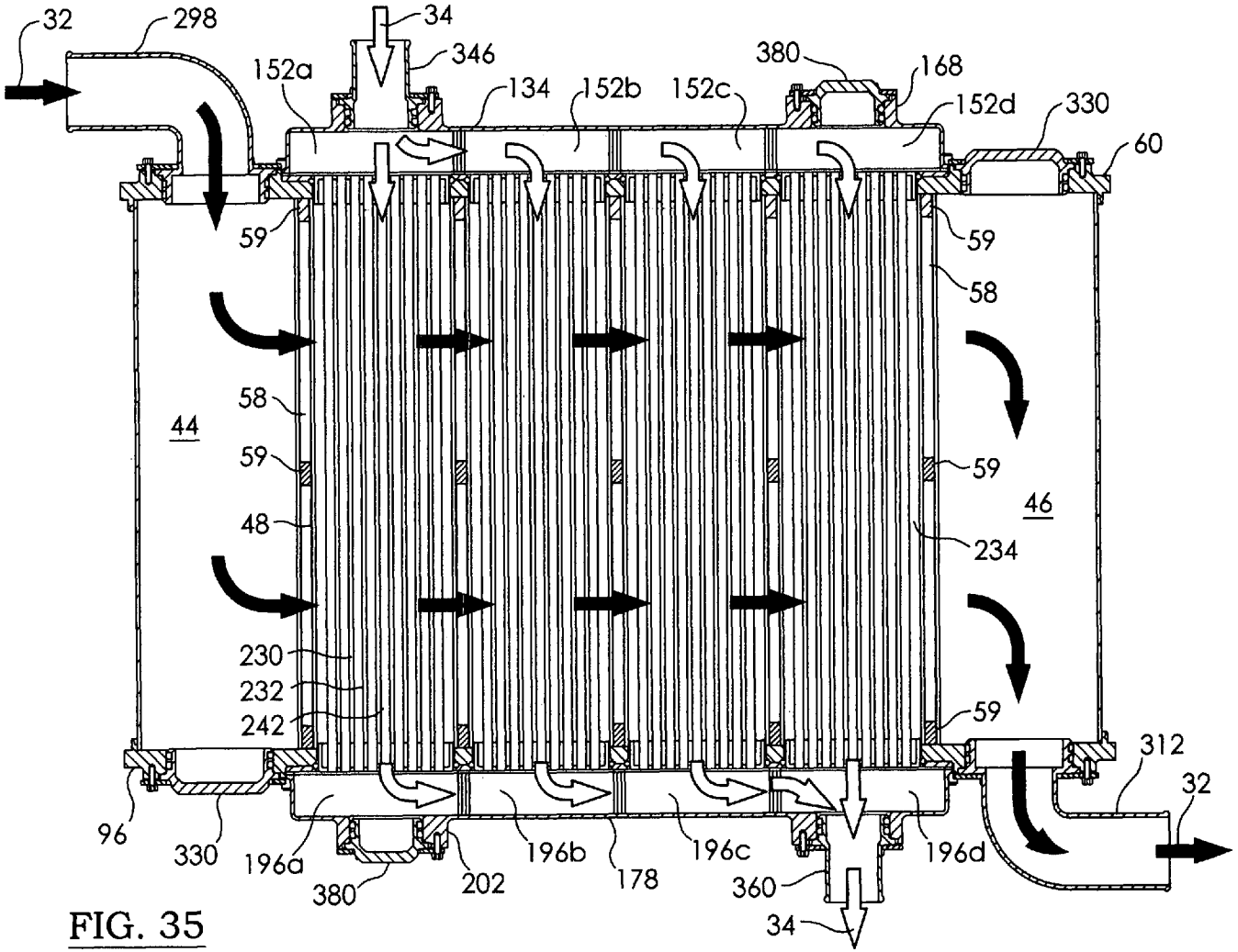
FIG. 35 is a front, cross-sectional, elevational view of the plastic heat exchanger of FIG. 1, taken along lines 44 of FIG. 2, and showing the flow pattern of the primary and secondary fluid coolants with no baffles installed in the manifolds.

The second manifold connector 360 has a central axis and a body 362 extending between upper 364 and lower 366 ends. The body lower end 366 has a pilot 368. The body upper end 364 has a nozzle 370. The nozzle 370 has an axis at an angle to the connector central axis of between zero and ninety degrees. The second manifold connector pilot 368 is removably and rotatably received within any one of the upper and lower manifold receiver bores 166, 176, 216, and 220. In one embodiment, the second manifold connector 360 is installed in the upper manifold last receiver bore 176, as shown in FIGS. 1, 2, 3, 36, 37, and 38. In another embodiment, the second manifold connector 360 is installed in the lower manifold last receiver bore 220, as shown in FIG. 35. The second manifold connector 360 has a circular bore 372 passing through the body 362 and in communication with the respective manifold receiver bore 166, 176, 216, and 220.

Manifold connector sealing means is provided for rotatably sealing the first 346 and second 360 manifold connectors to the manifold receivers. This is to allow connection of the nozzles 356 and 370 to the external conduits in any orientation. Specifically, at least one manifold connector O-ring 374 is sealingly juxtaposed between each one of the manifold connector pilots 354 and 368, and the respective one of the manifold receiver bores 166, 176, 216, and 220.

Retaining means is provided for retaining the manifold connector pilot in the receiver bore, while allowing selective rotation of the connector about the connector central axis. Specifically, the retaining means is a manifold connector retainer 376 secured by threaded fasteners 378.

Two manifold plugs 380 are provided to selectively block the flow of secondary fluid coolant 34. Each manifold plug 380 has a central axis and a body 382 extending between upper 384 and lower 386 ends, the body lower end 386 has a pilot 388. Each manifold plug pilot 388 is adapted to be removably received within one of the upper and lower manifold receiver bores 166, 176, 216, and 220.

Manifold plug sealing means is provided for sealing the manifold plugs 380 to the manifold receivers. Specifically, a manifold plug O-ring 390 is sealingly juxtaposed between each one of the manifold plug pilots 388 and the respective one of the manifold receiver bores 166, 176, 216, and 220.

Retaining means is provided for retaining the manifold plug pilot in the receiver bore. Specifically, the retaining means is a manifold plug retainer 392 secured by threaded fasteners 394.

The shell 36, the manifolds 134 and 178, the headers 222 and 226, and the flanges 60 and 96, are constructed of a non-metallic corrosion resistant polymeric material. The material is selected from the group consisting of thermoset resins and thermoplastic resins.

The tubes 230 are constructed of metal materials having efficient heat transfer properties. The metals are typically selected from the group consisting of copper, bronze, stainless steel, and Monel©. It is to be understood that other metals may be substituted. The headers 222 and 226 can also be metal.

Figure 12A:
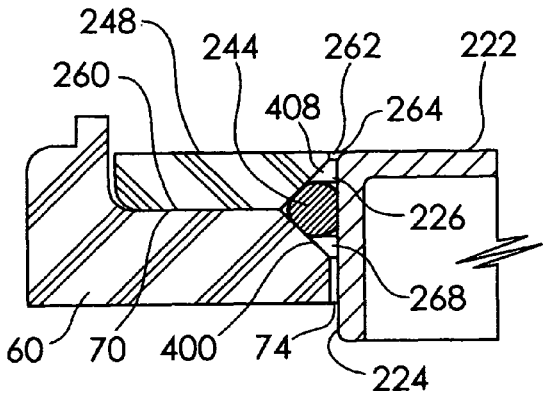
FIG. 12*a* is a partial, cross-sectional, elevational, detail view of the plastic heat exchanger of FIG. 1, taken at detail 12 of FIG. 9, showing the flange, seal plate, header, O-ring, and annular recess of the preferred embodiment.

Turning now to FIGS. 12*a*-12*f*, several different embodiments of the flange, seal plate, and annular recess are shown. FIG. 12*a* is taken from DETAIL 12 of FIG. 9 of the preferred embodiment. FIG. 12*a* illustrates the flange 60 having the flange hole 74 with a beveled edge 400 adjacent the outer surface 70. The seal plate 248 has the seal plate hole 262 with a beveled edge 408 adjacent the inner surface 260. The header 222 has the outer periphery 224 facing the two beveled edges. The two beveled edges 400 and 408 and the outer periphery 224 define the triangular shaped annular recess 266. The O-ring 244 is received in the annular recess 266 to seal the header and flange against leakage of primary fluid coolant 32 from below, and against leakage of secondary fluid coolant 34 from above.

Figure 12B:
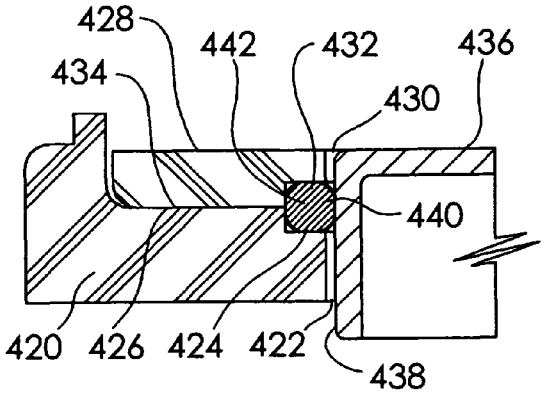
FIG. 12*b* is a partial, cross-sectional, elevational, detail view of the plastic heat exchanger of FIG. 1, taken at detail 12 of FIG. 9, showing the flange, seal plate, header, O-ring, and another embodiment of the annular recess.

Another embodiment, FIG. 12*b*, illustrates a flange 420 having a flange hole 422 with a shoulder 424 adjacent the outer surface 426. A seal plate 428 has a seal plate hole 430 with a shoulder 432 adjacent the inner surface 434. A header 436 has an outer periphery 438 facing the two shoulders. The two shoulders 424 and 432 and the outer periphery 438 define a rectangular shaped annular recess 440. An O-ring 442 is received in the annular recess 440.

Figure 12C:
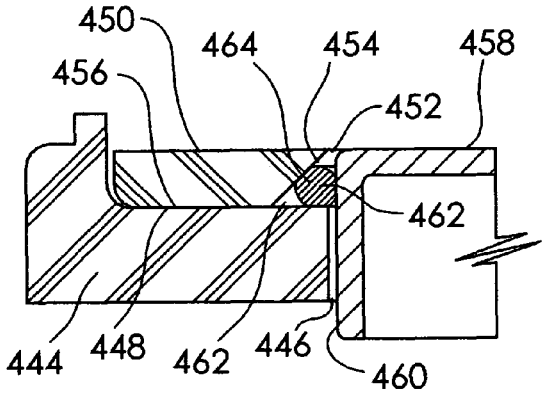
FIG. 12*c* is a partial, cross-sectional, elevational, detail view of the plastic heat exchanger of FIG. 1, taken at detail 12 of FIG. 9, showing the flange, seal plate, header, O-ring, and yet another embodiment of the annular recess.

Yet another embodiment, FIG. 12*c*, illustrates a flange 444 having a flange hole 446 and an outer surface 448. A seal plate 450 has a seal plate hole 452 with a beveled edge 454 adjacent the inner surface 456. A header 458 has an outer periphery 460 facing the beveled edge 454. The beveled edge 454, the outer surface 448 and the outer periphery 460 define a triangular shaped annular recess 462. An O-ring 464 is received in the annular recess 462.

Figure 12D:
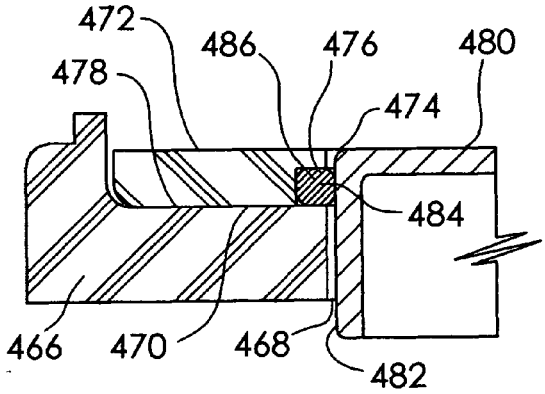
FIG. 12*d* is a partial, cross-sectional, elevational, detail view of the plastic heat exchanger of FIG. 1, taken at detail 12 of FIG. 9, showing the flange, seal plate, header, O-ring, and still another embodiment of the annular recess.

Still another embodiment, FIG. 12*d*, illustrates a flange 466 having a flange hole 468 with an outer surface 470. A seal plate 472 has a seal plate hole 474 with a shoulder 476 adjacent the inner surface 478. A header 480 has an outer periphery 482 facing the shoulder 476. The shoulder 476, the outer surface 470 and the outer periphery 482 define a rectangular shaped annular recess 484. An O-ring 486 is received in the annular recess 484.

Figure 12E:
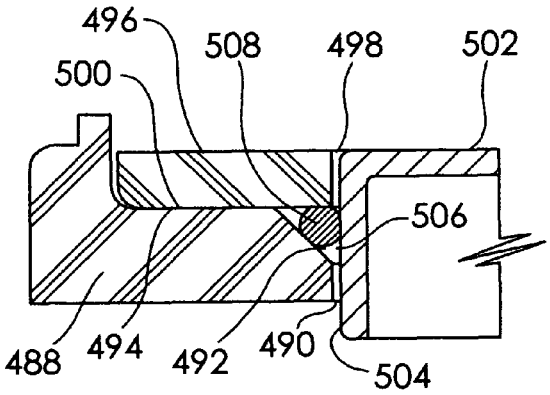
FIG. 12*e* is a partial, cross-sectional, elevational, detail view of the plastic heat exchanger of FIG. 1, taken at detail 12 of FIG. 9, showing the flange, seal plate, header, O-ring, and a further embodiment of the annular recess.

A further embodiment, FIG. 12*e*, illustrates a flange 488 having a flange hole 490 with a beveled edge 492 adjacent the outer surface 494. A seal plate 496 has a seal plate hole 498 and an inner surface 500. A header 502 has an outer periphery 504 facing the beveled edge 492. The beveled edge 492, the inner surface 500 and the outer periphery 504 define a triangular shaped annular recess 506. An O-ring 508 is received in the annular recess 506.

Figure 12F:
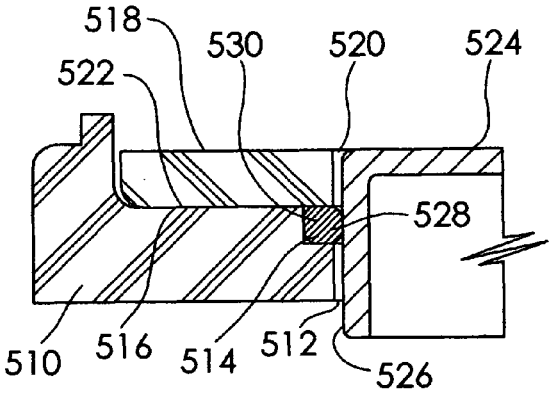
FIG. 12*f* is a partial, cross-sectional, elevational, detail view of the plastic heat exchanger of FIG. 1, taken at detail 12 of FIG. 9, showing the flange, seal plate, header, O-ring, and a yet further embodiment of the annular recess.
Figures 13, 14, 15, 16:
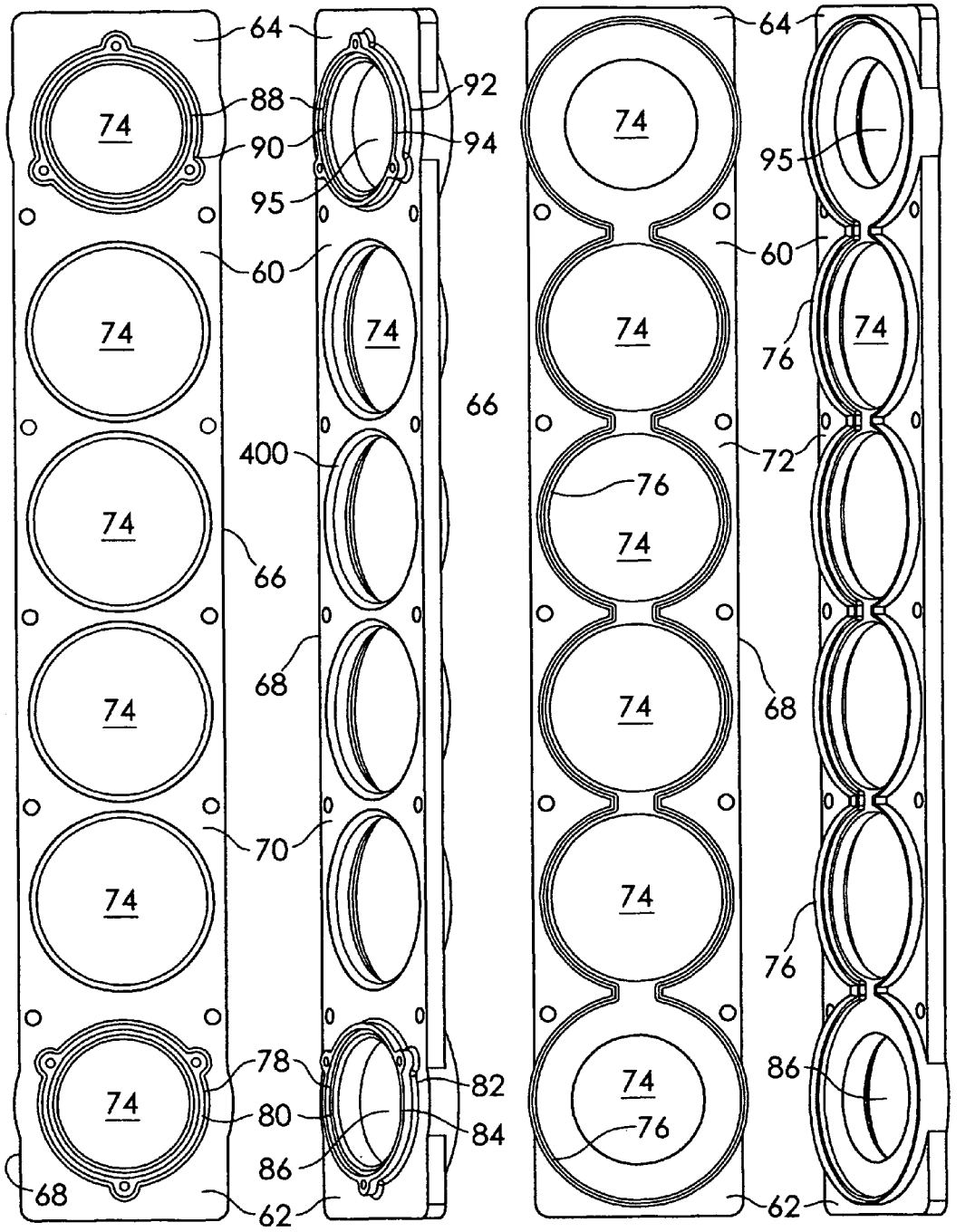
FIG. 13 is a top plan view of the upper flange of the plastic heat exchanger of FIG. 1.
FIG. 14 is a top perspective view of the upper flange of the plastic heat exchanger of FIG. 1.
FIG. 15 is a bottom view of the upper flange of the plastic heat exchanger of FIG. 1.
FIG. 16 is a bottom perspective view of the upper flange of the plastic heat exchanger of FIG. 1.
Figures 17, 18, 19, 20:
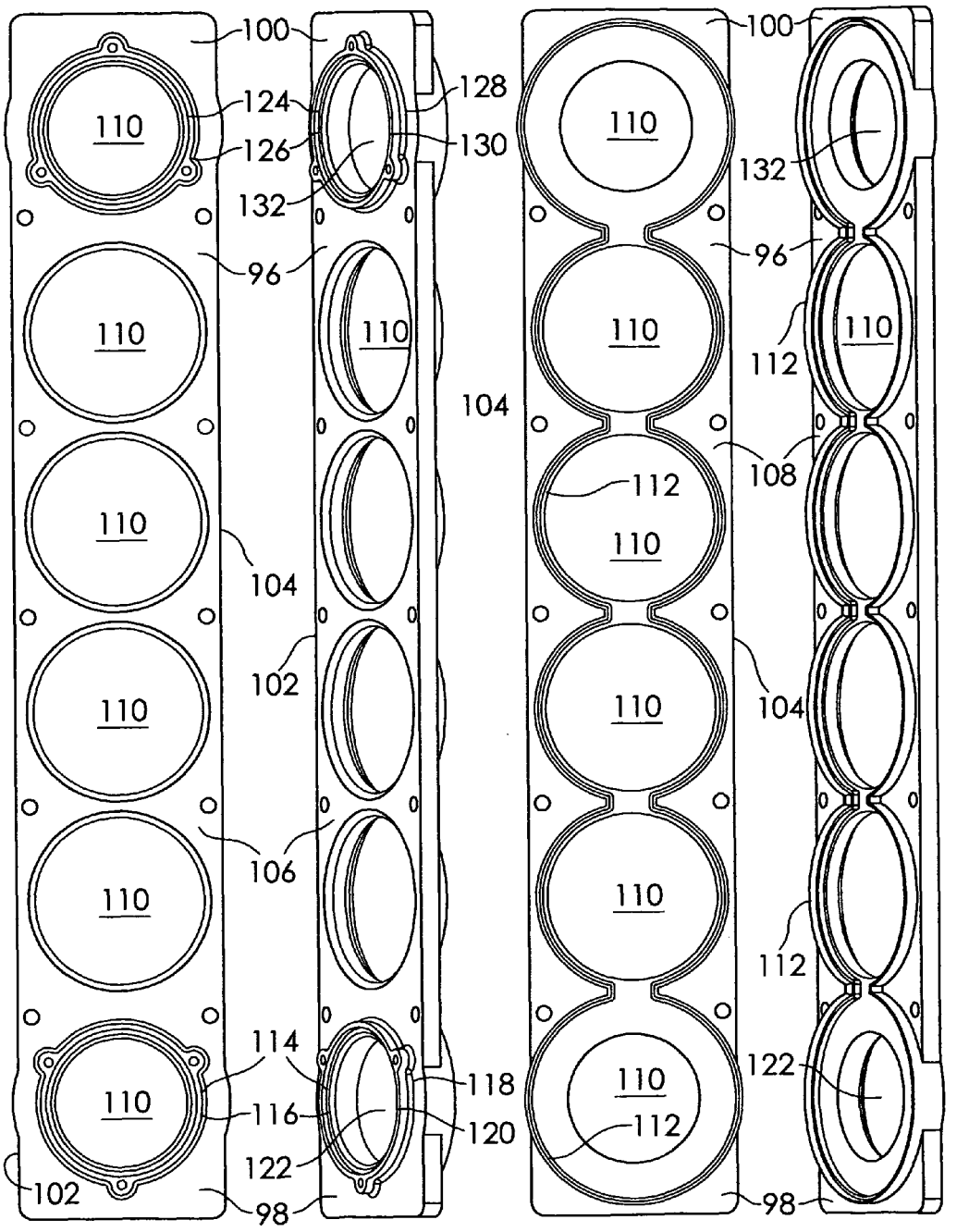
FIG. 17 is a top plan view of the lower flange of the plastic heat exchanger of FIG. 1.
FIG. 18 is a top perspective view of the lower flange of the plastic heat exchanger of FIG. 1.
FIG. 19 is a bottom view of the lower flange of the plastic heat exchanger of FIG. 1.
FIG. 20 is a bottom perspective view of the lower flange of the plastic heat exchanger of FIG. 1.
Figure 31:
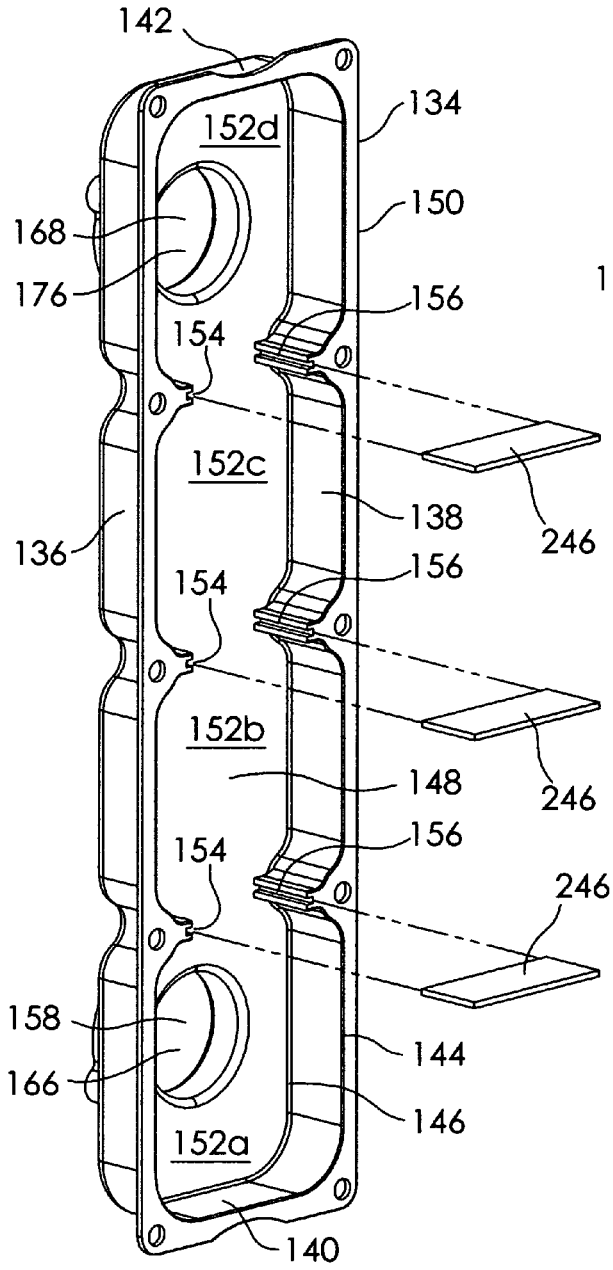
FIG. 31 is a bottom perspective view of the upper manifold of the plastic heat exchanger of FIG. 1, showing the baffles exploded.
Figure 32:
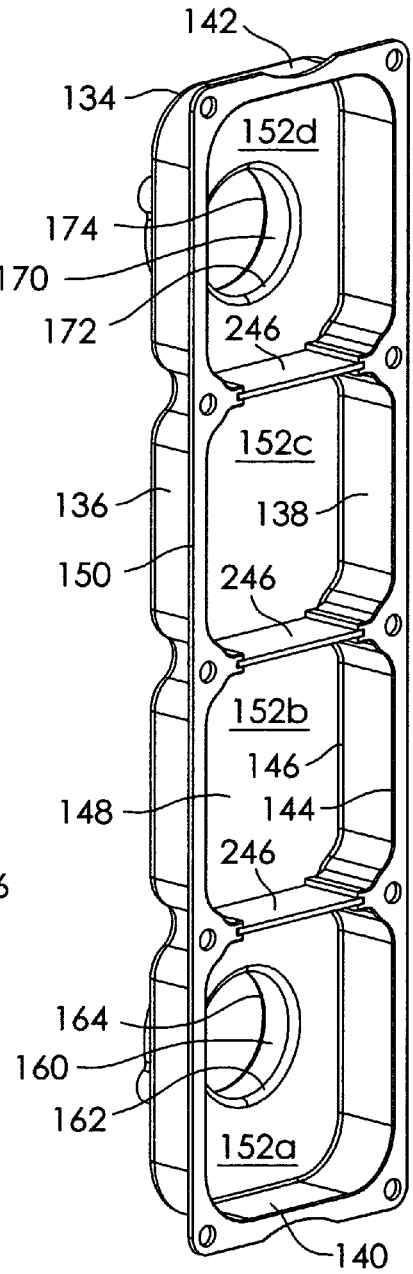
FIG. 32 is a bottom perspective view of the upper manifold of the plastic heat exchanger of FIG. 1, showing the baffles installed.
Figure 33:
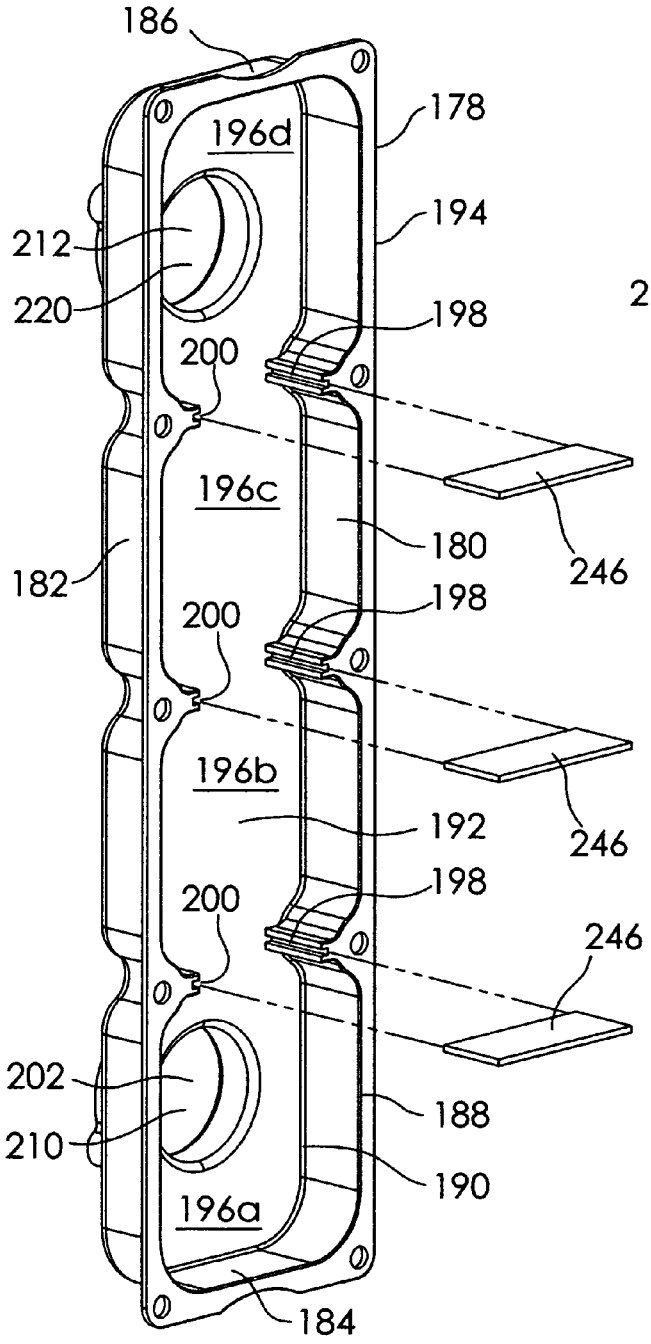
FIG. 33 is a bottom perspective view of the lower manifold of the plastic heat exchanger of FIG. 1, showing the baffles exploded.
Figure 34:
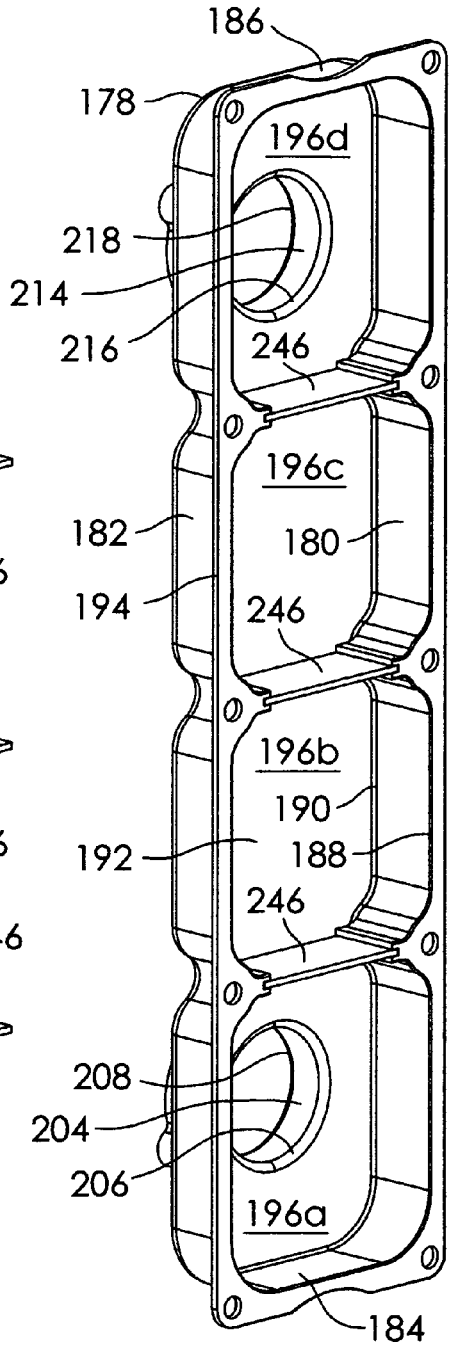
FIG. 34 is a bottom perspective view of the lower manifold of the plastic heat exchanger of FIG. 1, showing the baffles installed.

A yet further embodiment, FIG. 12*f*, illustrates a flange 510 having a flange hole 512 with a shoulder 514 adjacent the outer surface 516. A seal plate 518 has a seal plate hole 520 and an inner surface 522. A header 524 has an outer periphery 526 facing the shoulder 514. The shoulder 514, the inner surface 522 and the outer periphery 526 define a rectangular shaped annular recess 528. An O-ring 530 is received in the annular recess 528.

Figure 9:
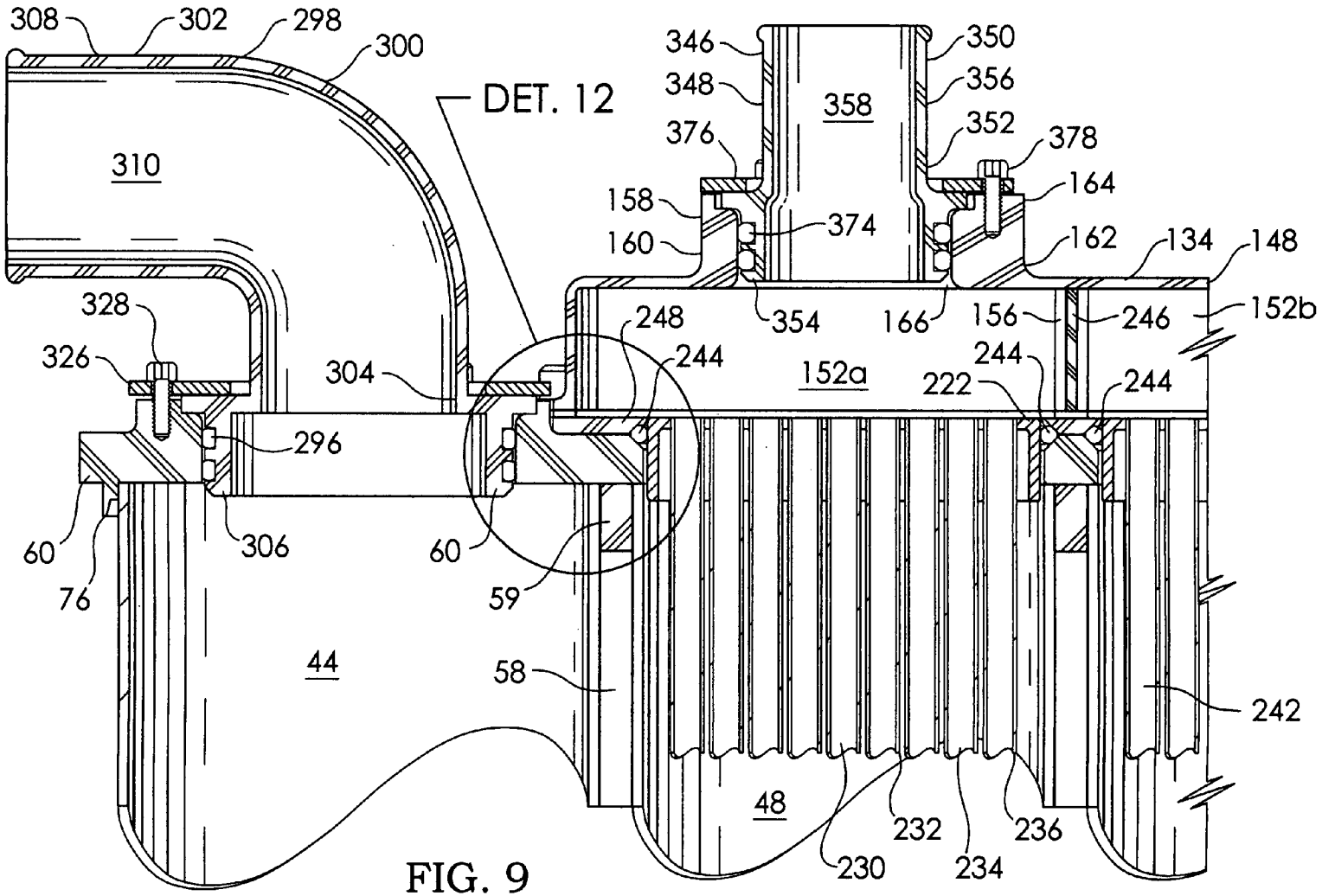
FIG. 9 is a partial, cross-sectional, elevational view of the plastic heat exchanger of FIG. 1, taken along lines 9-9 of FIG. 8.
Figure 10:
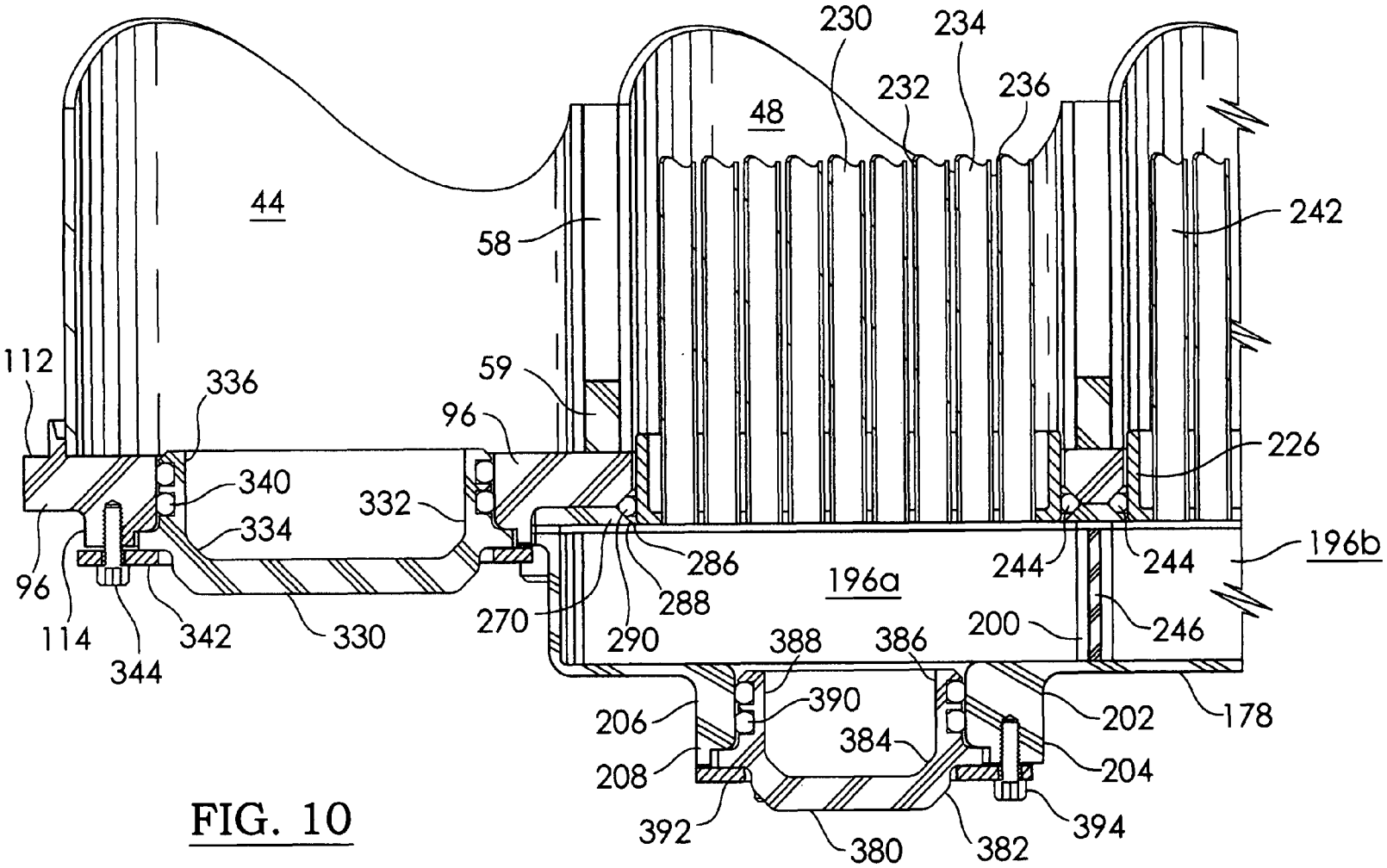
FIG. 10 is a partial, cross-sectional, elevational view of the plastic heat exchanger of FIG. 1, taken along lines 10-10 of FIG. 1.
Figure 11:
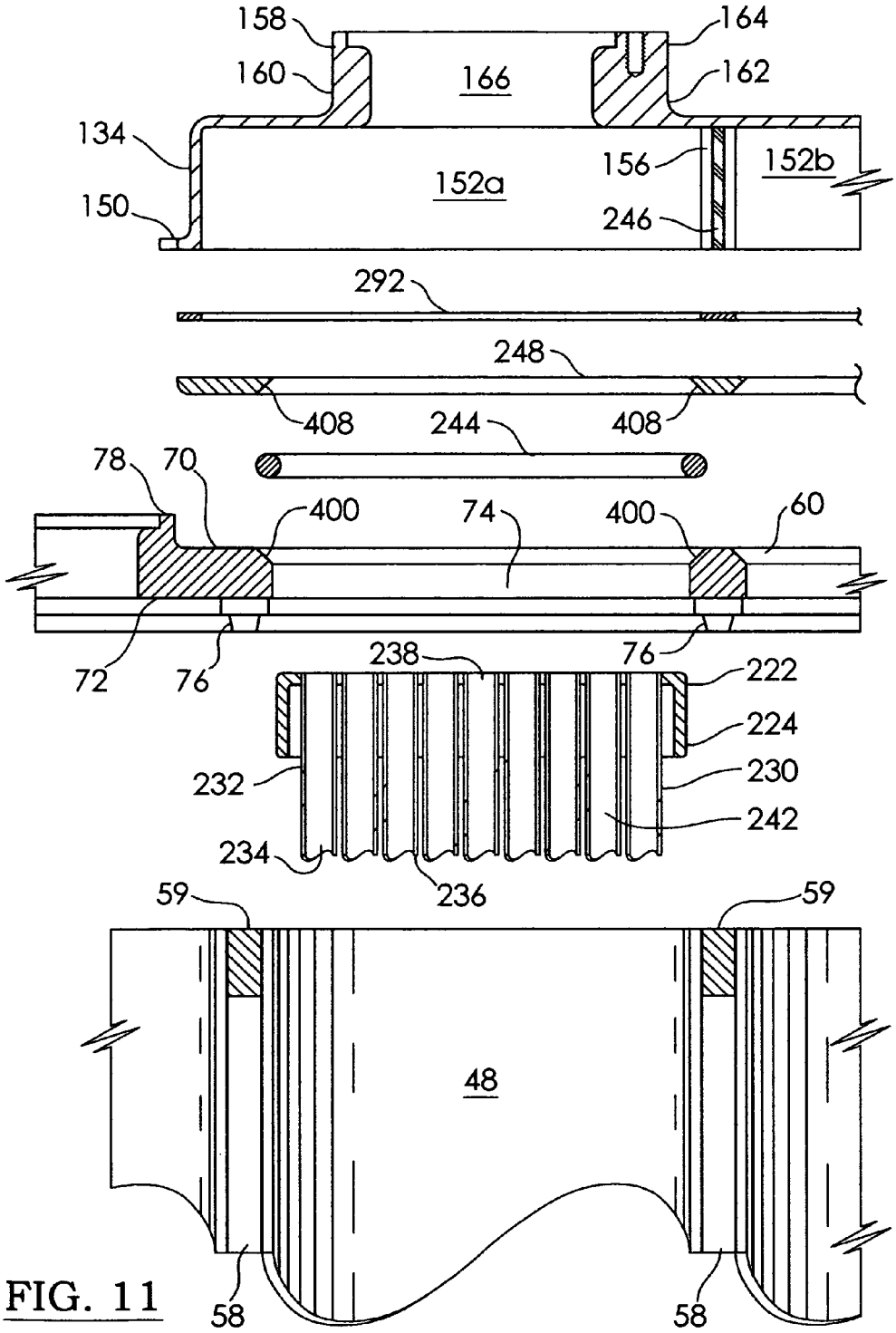
FIG. 11 is a partial, cross-sectional, exploded, elevational view of the plastic heat exchanger of FIG. 1, taken along lines 9-9 of FIG. 8.

Referring now to FIG. 35, as well as FIG. 9, a flow pattern is illustrated for the plastic heat exchanger 30 having no baffles 246 in either the upper 134 or lower 178 manifolds. The primary fluid coolant 32 will flow from the primary fluid coolant system through the first flange connector 298 into the first distribution tank 44. The primary fluid coolant will pass through the first one of the flow gaps 58 into the first heat transfer tank 48. The primary fluid coolant 32 will pass transversely across the outer surface 232 of each of the tubes 230 in the tube bundle 242. The primary fluid coolant 32 will pass through each consecutive heat transfer tank 48 and through the intervening flow gaps 58 into the last distribution tank 46. The primary fluid coolant 32 will then flow from the last distribution tank 46 through the second flange connector 312 and back into the primary fluid coolant system. The secondary fluid coolant 34 will flow from the secondary fluid coolant system through the first manifold connector 346 into the upper manifold 134. With no baffles installed, the secondary fluid coolant 34 will flood all four chambers 152*a*-152*d*. The secondary fluid coolant 34 will flow from the chambers 152*a*-152*d* into the bores 234 of each of the tubes 230 in all four tube bundles 242. Heat is allowed to flow between the primary fluid coolant 32 and the secondary fluid coolant 34 through the tube walls 236. The secondary fluid coolant 34 will flow into all four chambers 196a-196d of the lower manifold 178. The secondary fluid coolant 34 will then flow from the lower manifold 178 through the second manifold connector 360 into the secondary fluid coolant system. This is an example of cross-flow since the primary 32 and secondary 34 fluid coolants are moving at right angles to each other at all points in the heat transfer tanks 48. Flange plugs 330 are installed in the flange receivers 88 and 114 that are not used. Manifold plugs 380 are installed in the manifold receivers 168 and 202 that are not used.

Figure 36:
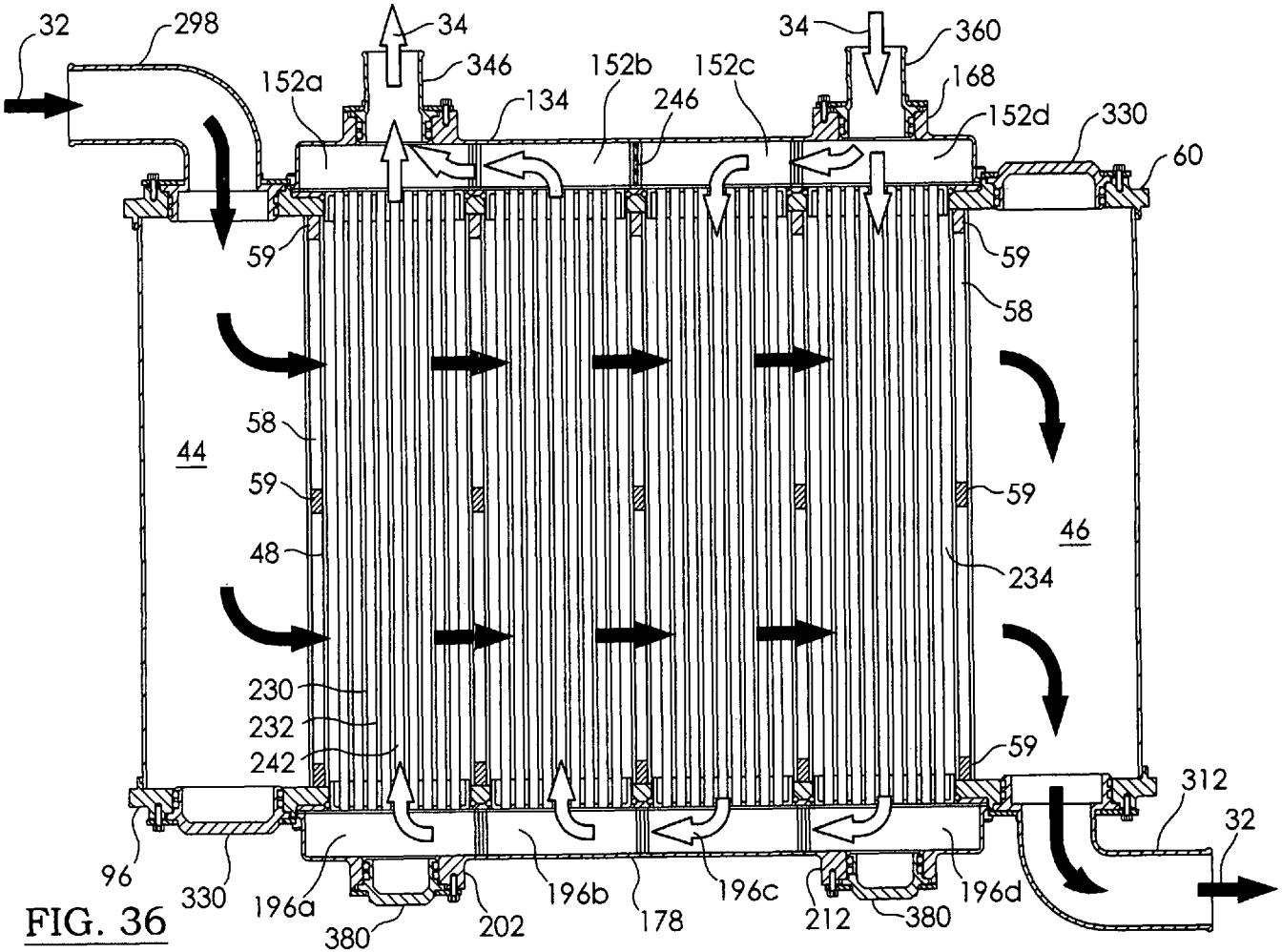
FIG. 36 is a front, cross-sectional, elevational view of the plastic heat exchanger of FIG. 1, taken along lines 4-4 of FIG. 2, and showing the flow pattern of the primary and secondary fluid coolants with one baffle installed in the upper manifold.

Turning now to FIG. 36, as well as FIG. 9, a flow pattern is illustrated for the plastic heat exchanger 30 having one baffle 246 in the upper manifold 134 and no baffle 246 in the lower manifold 178. The primary fluid coolant 32 will flow from the primary fluid coolant system through the first flange connector 298 into the first distribution tank 44. The primary fluid coolant will pass through the first one of the flow gaps 58 into the first heat transfer tank 48. The primary fluid coolant 32 will pass transversely across the outer surface 232 of each of the tubes 230 in the tube bundle 242. The primary fluid coolant 32 will pass through each consecutive heat transfer tank 48 and through the intervening flow gaps 58 into the last distribution tank 46. The primary fluid coolant 32 will then flow from the last distribution tank 46 through the second flange connector 312 and back into the primary fluid coolant system. The secondary fluid coolant 34 will flow from the secondary fluid coolant system through the second manifold connector 360 into the upper manifold 134. With one baffle 246 installed in the central pair of channels 198 and 200, the secondary fluid coolant 34 will flood two chambers 152*c* and 152*d*. The secondary fluid coolant 34 will flow downward from the chambers 152*c* and 152*d* into the bores 234 of each of the tubes 230 in two of the tube bundles 242. Heat is allowed to flow between the primary fluid coolant 32 and the secondary fluid coolant 34 through the tube walls 236. The secondary fluid coolant 34 will flow into two chambers 196*c* and 196*d* of the lower manifold 178 and pass into the remaining two chambers 196*a* and 196*b*. The secondary fluid coolant 34 will flow upward from the chambers 196*a* and 196*b* into the bores 234 of each of the tubes 230 in the remaining two of the tube bundles 242. The secondary fluid coolant 34 will flow into two chambers 152*a* and 152*b* of the upper manifold 134. The secondary fluid coolant 34 will then flow from the upper manifold 134 through the first manifold connector 346 into the secondary fluid coolant system. This is a combination of cross-flow and counter-flow. The primary 32 and secondary 34 fluid coolants are moving at right angles to each other at all points in the heat transfer tanks 48. The coolants 32 and 34 are also moving first through the downstream tube bundles, then through the upstream tube bundles. Both manifold connectors 346 and 360 are now on the upper manifold 134. Flange plugs 330 are installed in the flange receivers 88 and 114 that are not used. Manifold plugs 380 are installed in the manifold receivers 202 and 212 that are not used.

Figure 37:
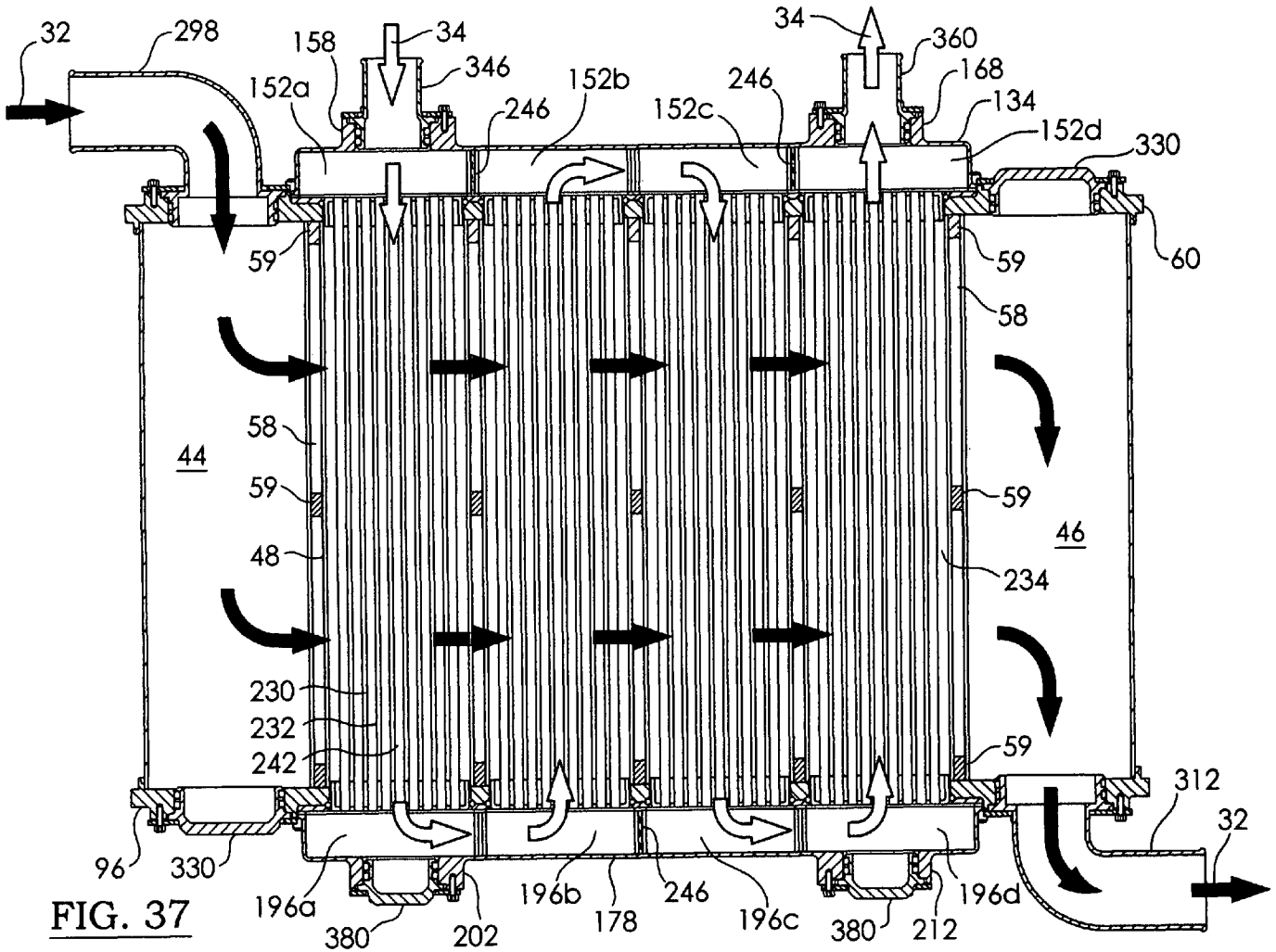
FIG. 37 is a front, cross-sectional, elevational view of the plastic heat exchanger of FIG. 1, taken along lines 4-4 of FIG. 2, and showing the flow pattern of the primary and secondary fluid coolants with two baffles installed in the upper manifold and one baffle installed in the lower manifold, and disclosing a parallel flow heat exchanger.
Figure 38:
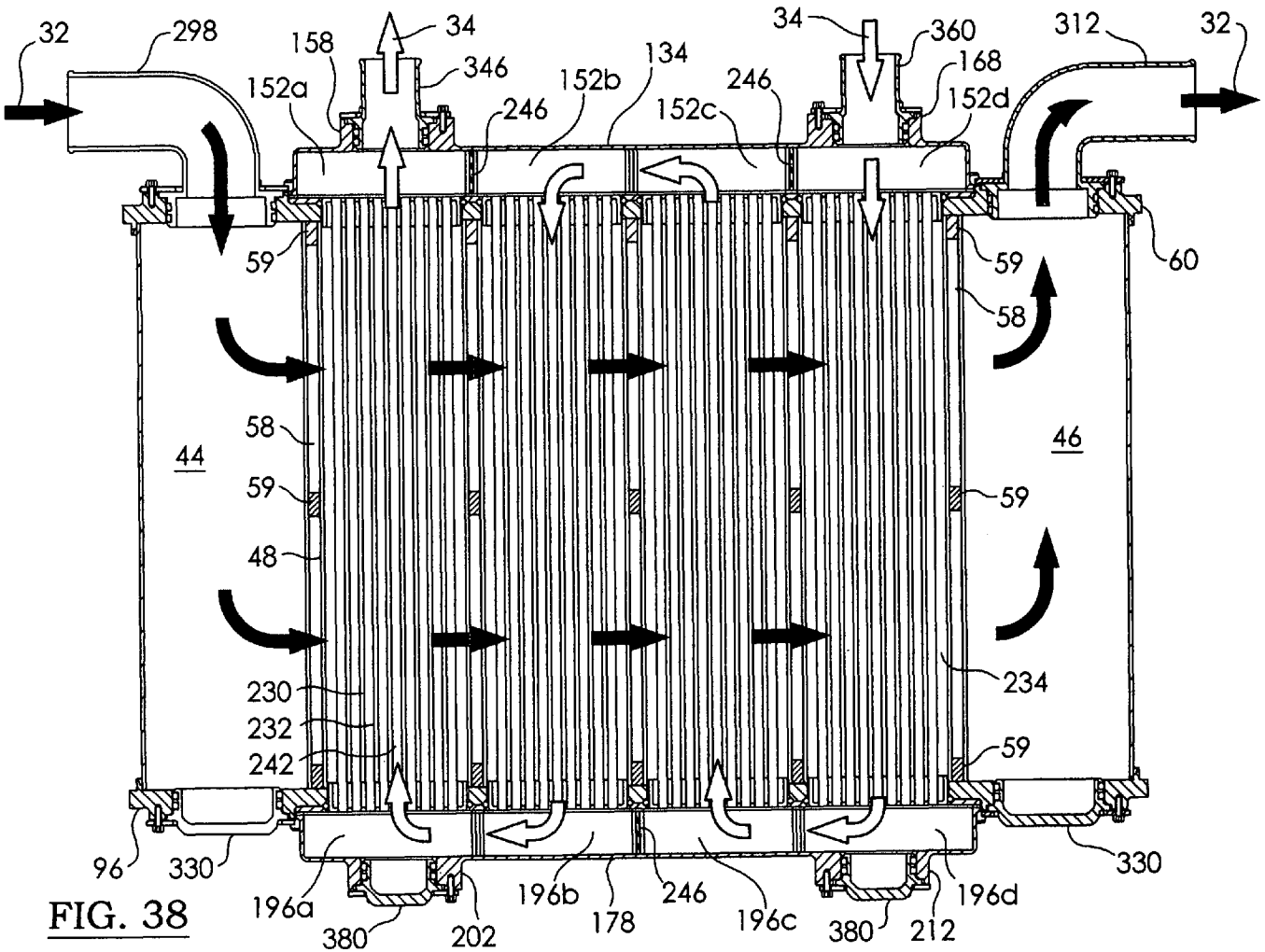
FIG. 38 is a front, cross-sectional, elevational view of the plastic heat exchanger of FIG. 1, taken along lines 4-4 of FIG. 2, and showing the flow pattern of the primary and secondary fluid coolants with two baffles installed in the upper manifold and one baffle installed in the lower manifold, and disclosing a counter flow heat exchanger.

Referring now to FIG. 37, as well as FIG. 9, a flow pattern is illustrated for the plastic heat exchanger 30 having two baffles 246 in the upper manifold 134 and one baffle 246 in the lower manifold 178. The primary fluid coolant 32 will flow from the primary fluid coolant system through the first flange connector 298 into the first distribution tank 44. The primary fluid coolant will pass through the first one of the flow gaps 58 into the first heat transfer tank 48. The primary fluid coolant 32 will pass transversely across the outer surface 232 of each of the tubes 230 in the tube bundle 242. The primary fluid coolant 32 will pass through each consecutive heat transfer tank 48 and through the intervening flow gaps 58 into the last distribution tank 46. The primary fluid coolant 32 will then flow from the last distribution tank 46 through the second flange connector 312 and back into the primary fluid coolant system. The secondary fluid coolant 34 will flow from the secondary fluid coolant system through the first manifold connector 346 into the upper manifold 134. With two baffles 246 installed in two pair of channels 198 and 200, the secondary fluid coolant 34 will flood the first chamber 152*a*. The secondary fluid coolant 34 will flow downward from the chamber 152*a* into the bores 234 of each of the tubes 230 in the first tube bundle 242. Heat is allowed to flow between the primary fluid coolant 32 and the secondary fluid coolant 34 through the tube walls 236. The secondary fluid coolant 34 will flow downward into chamber 196*a* of the lower manifold 178 and pass into the adjacent chamber 196*b*. The secondary fluid coolant 34 will flow upward from the chamber 196*b* into the bores 234 of each of the tubes 230 in the respective tube bundle 242. The secondary fluid coolant 34 will flow into chamber 152*b* of the upper manifold 134. The secondary fluid coolant 34 will then flow across to the adjacent chamber 152*c* and downward through the tube bundle 242 into chamber 196*c*. The secondary fluid coolant 34 will then flow across to the adjacent chamber 196*d* and upward through the tube bundle 242 into chamber 152*d*. The secondary fluid coolant 34 will then flow from the upper manifold 134 through the second manifold connector 360 into the secondary fluid coolant system. This is a combination of cross-flow and parallel-flow. The primary 32 and secondary 34 fluid coolants are moving at right angles to each other at all points in the heat transfer tanks 48. The coolants 32 and 34 are also moving first through the upstream tube bundles, then through the downstream tube bundles. Both manifold connectors 346 and 360 are on the upper manifold 134. Flange plugs 330 are installed in the flange receivers 88 and 114 that are not used. Manifold plugs 380 are installed in the manifold receivers 202 and 212 that are not used.

Referring now to FIG. 38, as well as FIG. 9, a flow pattern is illustrated for the plastic heat exchanger 30 having two baffles 246 in the upper manifold 134 and one baffle 246 in the lower manifold 178. The primary fluid coolant 32 will flow from the primary fluid coolant system through the first flange connector 298 into the first distribution tank 44. The primary fluid coolant will pass through the first one of the flow gaps 58 into the first heat transfer tank 48. The primary fluid coolant 32 will pass transversely across the outer surface 232 of each of the tubes 230 in the tube bundle 242. The primary fluid coolant 32 will pass through each consecutive heat transfer tank 48 and through the intervening flow gaps 58 into the last distribution tank 46. The primary fluid coolant 32 will then flow from the last distribution tank 46 through the second flange connector 312 and back into the primary fluid coolant system. The secondary fluid coolant 34 will flow from the secondary fluid coolant system through the second manifold connector 360 into the upper manifold 134. With two baffles 246 installed in two pair of channels 198 and 200, the secondary fluid coolant 34 will flood the last chamber 152*d*. The secondary fluid coolant 34 will flow downward from the chamber 152*d* into the bores 234 of each of the tubes 230 in the last tube bundle 242. Heat is allowed to flow between the primary fluid coolant 32 and the secondary fluid coolant 34 through the tube walls 236. The secondary fluid coolant 34 will flow downward into chamber 196*d* of the lower manifold 178 and pass into the adjacent chamber 196*c*. The secondary fluid coolant 34 will flow upward from the chamber 196*c* into the bores 234 of each of the tubes 230 in the respective tube bundle 242. The secondary fluid coolant 34 will flow into chamber 152*c* of the upper manifold 134. The secondary fluid coolant 34 will then flow across to the adjacent chamber 152*b* and downward through the tube bundle 242 into chamber 196*b*. The secondary fluid coolant 34 will then flow across to the adjacent chamber 196*a* and upward through the tube bundle 242 into chamber 152*a*. The secondary fluid coolant 34 will then flow from the upper manifold 134 through the first manifold connector 346 into the secondary fluid coolant system. This is a combination of cross-flow and counter-flow. The primary 32 and secondary 34 fluid coolants are moving at right angles to each other at all points in the heat transfer tanks 48. The coolants 32 and 34 are also moving first through the downstream tube bundles, then through the upstream tube bundles. Both manifold connectors 346 and 360 are on the upper manifold 134. Both flange connectors 298 and 312 are on the upper flange 60. Flange plugs 330 are installed in the flange receivers 114 and 124 that are not used. Manifold plugs 380 are installed in the manifold receivers 202 and 212 that are not used.

It is to be understood that the above-described combinations of baffles 246 and heat transfer tanks 48 are only a sampling of the preferred embodiments of the invention. Many more combinations are possible, such as five or six or more heat transfer tanks 48, and additional baffles 246. Alternatives to the flange connectors 298 and 312 and the manifold connectors 346 and 360 may be employed. Various sealing means are available and well known. Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. Details of the structure may be varied substantially without departing from the spirit of the invention and the exclusive use of all modifications that will come within the scope of the appended claims is reserved.

PARTS LIST PLASTIC HEAT EXCHANGER WITH EXTRUDED SHELL

Part No. Description
30 plastic heat exchanger
32 primary fluid coolant
34 secondary fluid coolant
36 shell
38 shell upper end
40 shell lower end
42 tanks
46 last distribution tank
48 heat transfer tanks
50 front web
52 rear web
54 web lower end
56 web upper end
58 flow gaps
60 upper flange
62 upper flange first end
64 upper flange second end
66 upper flange front edge
68 upper flange rear edge
70 upper flange outer surface
72 upper flange inner surface
74 upper flange holes
76 upper flange annular wall
78 upper flange first receiver
80 boss
82 proximal end
84 distal end
86 circular bore
88 upper flange last receiver
90 boss
92 proximal end
94 distal end
96 lower flange
98 lower flange first end
100 lower flange second end
102 lower flange front edge
104 lower flange rear edge
106 lower flange outer surface
108 lower flange inner surface
110 lower flange holes
112 lower flange annular wall
114 lower flange first receiver
116 boss
118 proximal end
120 distal end
122 circular bore
124 lower flange last receiver
126 boss
128 proximal end
130 distal end
132 circular bore
134 upper manifold
136 front wall
138 rear wall
140 first end wall
142 second end wall
144 inner edge
146 outer edge
148 outer plate
150 rim
152*a* chamber
152*b* chamber
152*c* chamber
152*d* chamber
154 front channel
156 rear channel
158 upper manifold first receiver
160 boss
162 proximal end
164 distal end
166 circular bore
168 upper manifold last receiver
170 boss
172 proximal end
174 distal end
176 circular bore
178 lower manifold
180 front wall
182 rear wall
184 first end wall
186 second end wall
188 inner edge
190 outer edge
192 outer edge
194 rim
196*a* chamber
196*b* chamber
196*c* chamber
196*d* chamber
198 front channel
200 rear channel
202 lower manifold first receiver
204 boss
206 proximal end
208 distal end
210 circular bore
212 lower manifold last receiver
214 boss
216 proximal end
218 distal end
220 circular bore
222 upper tube header
224 outer periphery
226 lower tube header
228 outer periphery
230 tubes
232 tube outer surface
234 tube bore
236 tube wall
238 upper open end
240 lower open end
242 tube bundle

244 header O-ring
246 baffle
248 upper seal plate
250 upper seal plate first end
252 upper seal plate second end
254 upper seal plate front edge
256 upper seal plate rear edge
258 upper seal plate outer surface
260 upper seal plate inner surface
262 upper seal plate hole
264 upper hole pair
266 upper annular recess
268 upper header O-ring groove
270 lower seal plate
271 flange threaded fasteners
272 lower seal plate first end
274 lower seal plate second end
276 lower seal plate front edge
278 lower seal plate rear edge
280 lower seal plate outer surface
282 lower seal plate inner surface
284 lower seal plate hole
286 lower hole pair
288 lower annular recess
290 lower header O-ring groove
292 upper seal
294 lower seal
296 flange connector O-ring
298 first flange connector
300 body
302 upper end
304 lower end
306 pilot
308 nozzle
310 circular bore
312 second flange connector
314 body
316 upper end
318 lower end
320 pilot
322 nozzle
324 circular bore
326 flange connector retainer
328 flange retainer threaded fasteners
330 flange plug
332 body
334 upper end
336 lower end
338 pilot
340 flange plug O-ring
342 flange plug retainer
344 upper end
346 first manifold connector
348 body
350 upper end
352 lower end
354 pilot
356 first manifold connector
358 circular bore
360 second manifold connector
362 body
364 upper end
366 lower end
368 pilot
370 nozzle
372 circular bore
374 manifold connector O-ring
376 manifold connector retainer
378 retainer threaded fasteners
380 manifold plug
382 body
384 upper end
386 lower end
388 pilot
390 manifold plug O-ring
392 manifold plug retainer
394 plug retainer threaded fasteners
400 beveled edge
408 beveled edge
420 flange
422 flange hole
424 shoulder
426 outer surface
428 seal plate
430 seal plate hole
432 shoulder
434 inner surface
436 header
438 outer periphery
440 annular recess
442 O-ring
444 flange
446 flange hole
448 outer surface
450 seal plate
452 seal plate hole
454 beveled edge
456 inner surface
458 header
460 outer periphery
462 annular recess
464 O-ring
466 flange
468 flange hole
470 outer surface
472 seal plate
474 seal plate hole
476 shoulder
478 inner surface
480 header
482 outer periphery
484 annular recess
486 O-ring
488 flange
490 flange hole
492 beveled edge
494 outer surface
496 seal plate
498 seal plate hole
500 inner surface
502 header
504 outer periphery
506 annular recess
508 O-ring
510 flange
512 flange hole
514 shoulder
516 outer surface
518 seal plate
520 seal plate hole
522 inner surface
524 header
526 outer periphery
528 annular recess

530 O-ring

The embodiments of the invention in which an exclusive property or privilege is claimed are defined as follows:

1. A plastic heat exchanger for transferring heat between a primary fluid coolant and a secondary fluid coolant, supplied by a primary fluid coolant system and a secondary fluid coolant system respectively, the coolants being carried by external conduits, the plastic heat exchanger comprising:

a shell, the shell extending between opposite upper and lower ends, the shell having a plurality of tanks, the tanks each having a cylindrical cross-section, the tanks being disposed side-by-side in an array, a first tank in the array being a first distribution tank, a last tank in the array being a last distribution tank, at least one tank intermediate the first and last tanks being a heat transfer tank, the tanks each being attached to adjacent tanks along opposite front and rear webs, the front and rear webs extending from a lower end adjacent the shell lower end to an upper end adjacent the shell upper end, the shell having a plurality of flow gaps, each flow gap being disposed between a respective front and rear web, the tanks each being in communication with adjacent tanks through the flow gaps, the distribution tanks being connected to the primary fluid coolant system;

an upper flange and a lower flange, the upper flange being disposed against the shell upper end, the lower flange being disposed against the shell lower end, each flange extending between opposite first and second ends, and between opposite front and rear edges, each flange having an outer surface facing away from the shell, each flange having an inner surface facing toward the shell, each flange having a plurality of flange holes, each flange hole being in alignment with one of the tanks and extending through the flange from the outer surface to the inner surface, each flange hole having an annular wall extending away from the inner surface, each upper flange annular wall being adapted to encircle one of the tanks at the shell upper end, each lower flange annular wall being adapted to encircle one of the tanks at the shell lower end, so as to preclude the shell from expanding outward under internal pressure;

an upper manifold and a lower manifold, the upper manifold being disposed adjacent the upper flange, the lower manifold being disposed adjacent the lower flange, the upper and lower manifolds each having a front wall, a rear wall, a first end wall, and a second end wall, the walls extending between inner and outer edges, the upper and lower manifolds each having an outer plate extending between the front and rear walls and between the first and second end walls along the outer edges thereof, the upper and lower manifolds each having a rim extending around the inner edges of the walls, the upper and lower manifolds each having at least one chamber enclosed within the front and rear walls, the first and second end walls, and the outer plate, the upper and lower manifolds each being connected to the secondary fluid coolant system, so as to convey the secondary fluid coolant between the secondary fluid coolant system and the heat transfer tank;

an upper tube header having an outer periphery, and a lower tube header having an outer periphery, the upper and lower tube headers being spaced apart and generally parallel;

a plurality of generally straight and parallel tubes extending between the upper and lower tube headers, the tubes each having an outer surface and a bore, the tubes each having a tube wall extending between the outer surface and the bore, the tubes each having upper and lower open ends attached to and penetrating the upper and lower tube headers, respectively;

wherein the upper tube header, the lower tube header, and the tubes comprise a tube bundle, the tube bundle being removably received within the heat transfer tank with the upper tube header being juxtaposed with the upper flange, and the lower tube header being juxtaposed with the lower flange;

header sealing means for sealing the upper and lower tube headers against leakage; and manifold sealing means for sealing the upper and lower manifolds against leakage; so that the primary fluid coolant will flow from the primary fluid coolant system into the first distribution tank, the primary fluid coolant will pass through one of the flow gaps into the heat transfer tank, the primary fluid coolant will pass transversely across the outer surface of each of the tubes in the tube bundle, the primary fluid coolant will pass through another one of the flow gaps into the last distribution tank, and the primary fluid coolant will then flow from the last distribution tank into the primary fluid coolant system, and the secondary fluid coolant will flow from the secondary fluid coolant system into one of the upper and lower manifolds, the secondary fluid coolant will pass through the flange hole in the respective one of the upper and lower flanges, the secondary fluid coolant will pass through the bore of each of the tubes in the tube bundle, the secondary fluid coolant will pass through the flange hole in the other one of the upper and lower flanges, the secondary fluid coolant will flow into the other one of the upper and lower manifolds, and the secondary fluid coolant will then flow from the respective manifold into the secondary fluid coolant system, so as to allow heat to flow between the primary fluid coolant and the secondary fluid coolant through the tube walls.

2. The plastic heat exchanger of claim 1, further comprising:

the shell having a plurality of heat transfer tanks;

the upper and lower manifolds each having a plurality of chambers, the chambers being disposed side-by-side in an array, each chamber corresponding to a respective heat transfer tank, each chamber being in communication with the adjacent chamber, each chamber being separated from the adjacent chamber by opposed front and rear channels, each front channel extending along the front wall between the inner and outer edges, each rear channel extending along the rear wall between the inner and outer edges; and at least one baffle removably received in a pair of the opposed front and rear channels, so as to selectively block communication between the respective adjacent chambers, and thereby control the flow of secondary fluid coolant.

3. The plastic heat exchanger of claim 1, wherein the header sealing means further comprises a header O-ring juxtaposed between the header and the flange.

4. The plastic heat exchanger of claim 3, wherein the header sealing means further comprises an upper seal plate and a lower seal plate, the upper seal plate being disposed against the upper flange outer surface, the lower seal plate being disposed against the lower flange outer surface, each seal plate extending between opposite first and second ends, and between opposite front and rear edges, each seal plate having an outer surface facing away from the shell, each seal plate having an inner surface facing toward the shell, each seal plate having a seal plate hole for each heat transfer tank, each seal plate hole extending through the seal plate from the outer surface to the inner surface, each seal plate hole being juxtaposed in collinear alignment with one of the flange holes, defining a hole pair, each hole pair having at least one annular recess, each hole pair receiving one of the tube headers therein, with the tube header outer periphery and the respective hole pair annular recess defining a header O-ring groove, the header O-ring being received in the header O-ring groove.

5. The plastic heat exchanger of claim 1, wherein the manifold sealing means further comprises:

an upper seal extending around the upper manifold rim and juxtaposed between the upper manifold rim and the upper flange; and a lower seal extending around the lower manifold rim and juxtaposed between the lower manifold rim and the lower flange.

6. The plastic heat exchanger of claim 1, further comprising:

at least one upper flange receiver and at least one lower flange receiver, the upper and lower flange receivers being unitary with the upper and lower flanges respectively, each flange receiver having a central axis, each flange receiver having a boss extending between a proximal end at the flange outer surface and a distal end, each flange receiver having a circular bore passing through the boss and in communication with one of the first and last tanks;

first and second flange connectors, each flange connector having a central axis and a body extending between upper and lower ends, the body lower end having a pilot, the body upper end having a nozzle, the nozzle having an axis at an angle to the connector central axis of between zero and ninety degrees, each flange connector pilot being removably and rotatably received within one of the upper and lower flange receiver bores, each flange connector having a circular bore passing through the body and in communication with the respective flange receiver bore;

flange connector sealing means for rotatably sealing the first and second flange connectors to the flange receivers, so as to allow connection of the nozzles to the external conduits in any orientation; and retaining means for retaining the connector pilot in the receiver bore, while allowing selective rotation of the connector about the connector central axis.

7. The plastic heat exchanger of claim 6, further comprising:

at least one flange plug, each flange plug having a central axis and a body extending between upper and lower ends, the body lower end having a pilot, each flange plug pilot being adapted to be removably received within one of the upper and lower flange receiver bores, so as to selectively block the flow of primary fluid coolant;

flange plug sealing means for sealing the flange plug to the flange receiver; and retaining means for retaining the flange plug pilot in the receiver bore.

8. The plastic heat exchanger of claim 7, wherein:

the flange connector sealing means further comprises at least one flange connector O-ring sealingly juxtaposed between the flange connector pilot and the flange receiver bore; and the flange plug sealing means further comprises at least one flange plug O-ring sealingly juxtaposed between the flange plug pilot and the flange receiver bore.

9. The plastic heat exchanger of claim 1, further comprising:

at least one upper manifold receiver and at least one lower manifold receiver, the upper and lower manifold receivers being unitary with the upper and lower manifolds respectively, each manifold receiver having a central axis, each manifold receiver having a boss extending between a proximal end at the manifold outer plate and a distal end, each manifold receiver having a circular bore passing through the boss and in communication with the chamber;

first and second manifold connectors, each manifold connector having a central axis and a body extending between upper and lower ends, the body lower end having a pilot, the body upper end having a nozzle, the nozzle having an axis at an angle to the connector central axis of between zero and ninety degrees, each manifold connector pilot being removably and rotatably received within one of the upper and lower manifold receiver bores, each manifold connector having a circular bore passing through the body and in communication with the respective manifold receiver bore;

manifold connector sealing means for rotatably sealing the first and second manifold connectors to the manifold receivers, so as to allow connection of the nozzles to the external conduits in any orientation; and retaining means for retaining the connector pilot in the receiver bore, while allowing selective rotation of the connector about the connector central axis.

10. The plastic heat exchanger of claim 9, further comprising:

at least one manifold plug, each manifold plug having a central axis and a body extending between upper and lower ends, the body lower end having a pilot, each manifold plug pilot being adapted to be removably received within one of the upper and lower manifold receiver bores, so as to selectively block the flow of secondary fluid coolant;

manifold plug sealing means for sealing the manifold plug to the manifold receiver; and retaining means for retaining the manifold plug pilot in the receiver bore.

11. The plastic heat exchanger of claim 10, wherein:

the manifold connector sealing means further comprises at least one manifold connector O-ring sealingly juxtaposed between the manifold connector pilot and the manifold receiver bore; and the manifold plug sealing means further comprises at least one manifold plug O-ring sealingly juxtaposed between the manifold plug pilot and the manifold receiver bore.

12. The plastic heat exchanger of claim 1, further comprising a plurality of spacers, at least two spacers being disposed in each flow gap between a respective front and rear web adjacent the web upper and lower ends, so as to maintain the flow gaps in an open condition.

13. The plastic heat exchanger of claim 1, further comprising:

the shell, manifolds, and flanges are constructed of a non-metallic corrosion resistant material; and the tubes are constructed of metal materials having efficient heat transfer properties.

14. A plastic heat exchanger for transferring heat between a primary fluid coolant and a secondary fluid coolant, supplied by a primary fluid coolant system and a secondary fluid coolant system respectively, the coolants being carried by external conduits, the plastic heat exchanger comprising:

a shell, the shell extending between opposite upper and lower ends, the shell having a plurality of tanks, the tanks each having a cylindrical cross-section, the tanks being disposed side-by-side in an array, a first tank in the array being a first distribution tank, a last tank in the array being a last distribution tank, the tanks intermediate the first and last tanks being heat transfer tanks, the tanks each being attached to adjacent tanks along opposite front and rear webs, the front and rear webs extending from a lower end adjacent the shell lower end to an upper end adjacent the shell upper end, the shell having a plurality of flow gaps, each flow gap being disposed between a respective front and rear web, the tanks each being in communication with adjacent tanks through the flow gaps, the distribution tanks being connected to the primary fluid coolant system;

an upper flange and a lower flange, the upper flange being sealingly attached to the shell upper end with an adhesive, the lower flange being sealingly attached to the shell lower end with an adhesive, each flange extending between opposite first and second ends, and between opposite front and rear edges, each flange having an outer surface facing away from the shell, each flange having an inner surface facing toward the shell, each flange having a plurality of flange holes, each flange hole being in alignment with one of the tanks and extending through the flange from the outer surface to the inner surface, each flange hole having an annular wall extending away from the inner surface, each upper flange annular wall being adapted to encircle one of the tanks at the shell upper end, each lower flange annular wall being adapted to encircle one of the tanks at the shell lower end, so as to preclude the shell from expanding outward under internal pressure;

an upper manifold and a lower manifold, the upper manifold being disposed adjacent the upper flange, the lower manifold being disposed adjacent the lower flange, the upper and lower manifolds each having a front wall, a rear wall, a first end wall, and a second end wall, the walls extending between inner and outer edges, the upper and lower manifolds each having an outer plate extending between the front and rear walls and between the first and second end walls along the outer edges thereof, the upper and lower manifolds each having a rim extending around the inner edges of the walls, the upper and lower manifolds each having a plurality of chambers enclosed within the front and rear walls, the first and second end walls, and the outer plate, the chambers being disposed side-by-side in an array, each chamber corresponding to a respective heat transfer tank, each chamber being in communication with the adjacent chamber, each chamber being separated from the adjacent chamber by opposed front and rear channels, each front channel extending along the front wall between the inner and outer edges, each rear channel extending along the rear wall between the inner and outer edges, the upper and lower manifolds each being connected to the secondary fluid coolant system, so as to convey the secondary fluid coolant between the secondary fluid coolant system and the heat transfer tanks;

an upper tube header having an outer periphery, and a lower tube header having an outer periphery, the upper and lower tube headers being spaced apart and generally parallel;

a plurality of generally straight and parallel tubes extending between the upper and lower tube headers, the tubes each having an outer surface and a bore, the tubes each having a tube wall extending between the outer surface and the bore, the tubes each having upper and lower open ends attached to and penetrating the upper and lower tube headers, respectively;

a plurality of tube bundles, wherein the upper tube header, the lower tube header, and the tubes comprise a tube bundle, each tube bundle being removably received within one of the heat transfer tanks, with the upper tube header being juxtaposed with the upper flange, and the lower tube header being juxtaposed with the lower flange;

header sealing means for sealing the upper and lower tube headers against leakage; and manifold sealing means for sealing the upper and lower manifolds against leakage; so that the primary fluid coolant will flow from the primary fluid coolant system into the first distribution tank, the primary fluid coolant will pass through one of the flow gaps into the heat transfer tank, the primary fluid coolant will pass transversely across the outer surface of each of the tubes in the tube bundle, the primary fluid coolant will pass through another one of the flow gaps into the last distribution tank, and the primary fluid coolant will then flow from the last distribution tank into the primary fluid coolant system, and the secondary fluid coolant will flow from the secondary fluid coolant system into one of the upper and lower manifolds, the secondary fluid coolant will pass through the flange hole in the respective one of the upper and lower flanges, the secondary fluid coolant will pass through the bore of each of the tubes in the tube bundle, the secondary fluid coolant will pass through the flange hole in the other one of the upper and lower flanges, the secondary fluid coolant will flow into the other one of the upper and lower manifolds, and the secondary fluid coolant will then flow from the respective manifold into the secondary fluid coolant system, so as to allow heat to flow between the primary fluid coolant and the secondary fluid coolant through the tube walls.

15. The plastic heat exchanger of claim 14, further comprising at least one baffle removably received in a pair of the opposed front and rear channels, so as to selectively block communication between the respective adjacent chambers, and thereby control the flow of secondary fluid coolant.

16. The plastic heat exchanger of claim 14, wherein the header sealing means further comprises a header O-ring juxtaposed between the header and the flange.

17. The plastic heat exchanger of claim 16, wherein the header sealing means further comprises an upper seal plate and a lower seal plate, the upper seal plate being disposed against the upper flange outer surface, the lower seal plate being disposed against the lower flange outer surface, each seal plate extending between opposite first and second ends, and between opposite front and rear edges, each seal plate having an outer surface facing away from the shell, each seal plate having an inner surface facing toward the shell, each seal plate having a seal plate hole for each heat transfer tank, each seal plate hole extending through the seal plate from the outer surface to the inner surface, each seal plate hole being juxtaposed in collinear alignment with one of the flange holes, defining a hole pair, each hole pair having at least one annular recess, each hole pair receiving one of the tube headers therein, with the tube header outer periphery and the respective hole pair annular recess defining a header O-ring groove, the header O-ring being received in the header O-ring groove.

18. The plastic heat exchanger of claim 14, wherein the manifold sealing means further comprises:

an upper seal extending around the upper manifold rim and juxtaposed between the upper manifold rim and the upper flange; and a lower seal extending around the lower manifold rim and juxtaposed between the lower manifold rim and the lower flange.

19. The plastic heat exchanger of claim 14, further comprising:

an upper flange first receiver and an upper flange last receiver, the upper flange first and last receivers being unitary with the upper flange, each flange receiver having a central axis, each flange receiver having a boss extending between a proximal end at the flange outer surface and a distal end, the upper flange first and last receivers each having a circular bore passing through the boss and in communication with the first and last tanks respectively;

a lower flange first receiver and a lower flange last receiver, the lower flange first and last receivers being unitary with the lower flange, each flange receiver having a central axis, each flange receiver having a boss extending between a proximal end at the flange outer surface and a distal end, the lower flange first and last receivers each having a circular bore passing through the boss and in communication with the first and last tanks respectively;

a flange first connector and a flange second connector, each flange connector having a central axis and a body extending between upper and lower ends, the body lower end having a pilot, the body upper end having a nozzle, the nozzle having an axis at an angle to the connector central axis of between zero and ninety degrees, each flange connector pilot being removably and rotatably received within one of the upper and lower flange receiver bores, each flange connector having a circular bore passing through the body and in communication with the respective flange receiver bore;

flange connector sealing means for rotatably sealing the flange first and second connectors to the flange receivers, so as to allow connection of the nozzles to the external conduits in any orientation; and retaining means for retaining the connector pilot in the receiver bore, while allowing selective rotation of the connector about the connector central axis.

20. The plastic heat exchanger of claim 19, further comprising:

at least one flange plug, each flange plug having a central axis and a body extending between upper and lower ends, the body lower end having a pilot, each flange plug pilot being adapted to be removably received within one of the upper and lower flange receiver bores, so as to selectively block the flow of primary fluid coolant;

flange plug sealing means for sealing the flange plug to the flange receiver; and retaining means for retaining the flange plug pilot in the receiver bore.

21. The plastic heat exchanger of claim 20, wherein:

the flange connector sealing means further comprises at least one flange connector O-ring sealingly juxtaposed between the flange connector pilot and the flange receiver bore; and the flange plug sealing means further comprises at least one flange plug O-ring sealingly juxtaposed between the flange plug pilot and the flange receiver bore.

22. The plastic heat exchanger of claim 14, further comprising:

an upper manifold first receiver and an upper manifold last receiver, the upper manifold first and last receivers being unitary with the upper manifold, each upper manifold receiver having a central axis, each upper manifold receiver having a boss extending between a proximal end at the upper manifold outer plate and a distal end, the upper manifold first and last receivers each having a circular bore passing through the boss and in communication with one of the chambers;

a lower manifold first receiver and a lower manifold last receiver, the lower manifold first and last receivers being unitary with the lower manifold, each lower manifold receiver having a central axis, each lower manifold receiver having a boss extending between a proximal end at the lower manifold outer plate and a distal end, the lower manifold first and last receivers each having a circular bore passing through the boss and in communication with one of the chambers;

a manifold first connector and a manifold second connector, each manifold connector having a central axis and a body extending between upper and lower ends, the body lower end having a pilot, the body upper end having a nozzle, the nozzle having an axis at an angle to the connector central axis of between zero and ninety degrees, each manifold connector pilot being removably and rotatably received within one of the upper and lower manifold receiver bores, each manifold connector having a circular bore passing through the body and in communication with the respective manifold receiver bore;

manifold connector sealing means for rotatably sealing the manifold first and second connectors to the manifold receivers, so as to allow connection of the nozzles to the external conduits in any orientation; and retaining means for retaining the connector pilot in the receiver bore, while allowing selective rotation of the connector about the connector central axis.

23. The plastic heat exchanger of claim 22, further comprising:

at least one manifold plug, each manifold plug having a central axis and a body extending between upper and lower ends, the body lower end having a pilot, each manifold plug pilot being adapted to be removably received within one of the upper and lower manifold receiver bores, so as to selectively block the flow of secondary fluid coolant;

manifold plug sealing means for sealing the manifold plug to the manifold receiver; and retaining means for retaining the manifold plug pilot in the receiver bore.

24. The plastic heat exchanger of claim 23, wherein:

the manifold connector sealing means further comprises at least one manifold connector O-ring sealingly juxtaposed between the manifold connector pilot and the manifold receiver bore; and the manifold plug sealing means further comprises at least one manifold plug O-ring sealingly juxtaposed between the manifold plug pilot and the manifold receiver bore.

25. The plastic heat exchanger of claim 14, further comprising a plurality of spacers, at least two spacers being disposed in each flow gap between a respective front and rear web adjacent the web upper and lower ends, so as to maintain the flow gaps in an open condition.

26. The plastic heat exchanger of claim 14, wherein:

the shell, manifolds, and flanges are constructed of a non-metallic corrosion resistant polymeric material selected from the group consisting of thermoset resins and thermoplastic resins; and the tubes are constructed of metal materials having efficient heat transfer properties selected from the group consisting of copper, bronze, stainless steel, and Monel.

27. A plastic heat exchanger for transferring heat between a primary fluid coolant and a secondary fluid coolant, supplied by a primary fluid coolant system and a secondary fluid coolant system respectively, the coolants being carried by external conduits, the plastic heat exchanger comprising:

a shell, the shell extending between opposite upper and lower ends, the shell having a plurality of tanks, the tanks each having a cylindrical cross-section, the tanks being disposed side-by-side in an array, a first tank in the array being a first distribution tank, a last tank in the array being a last distribution tank, the tanks intermediate the first and last tanks being heat transfer tanks, the tanks each being attached to adjacent tanks along opposite front and rear webs, the front and rear webs extending from a lower end adjacent the shell lower end to an upper end adjacent the shell upper end, the shell having a plurality of flow gaps, each flow gap being disposed between a respective front and rear web, the tanks each being in communication with adjacent tanks through the flow gaps, the distribution tanks being connected to the primary fluid coolant system;

an upper flange, the upper flange being sealingly attached to the shell upper end with an adhesive, the upper flange extending between opposite first and second ends, and between opposite front and rear edges, the upper flange having an outer surface facing away from the shell and an inner surface facing toward the shell, the upper flange having a plurality of flange holes, each flange hole being in alignment with one of the tanks and extending through the upper flange from the outer surface to the inner surface, each flange hole having an annular wall extending away from the inner surface, each upper flange annular wall being adapted to encircle one of the tanks at the shell upper end, so as to preclude the shell from expanding outward under internal pressure, the upper flange having an upper flange first receiver and an upper flange last receiver, the upper flange first and last receivers being unitary with the upper flange, each flange receiver having a central axis, each flange receiver having a boss extending between a proximal end at the flange outer surface and a distal end, the upper flange first and last receivers each having a circular bore passing through the boss and in communication with the first and last tanks respectively;

a lower flange, the lower flange being sealingly attached to the shell lower end with an adhesive, the lower flange extending between opposite first and second ends, and between opposite front and rear edges, the lower flange having an outer surface facing away from the shell and an inner surface facing toward the shell, the lower flange having a plurality of flange holes, each flange hole being in alignment with one of the tanks and extending through the lower flange from the outer surface to the inner surface, each flange hole having an annular wall extending away from the inner surface, each lower flange annular wall being adapted to encircle one of the tanks at the shell lower end, so as to preclude the shell from expanding outward under internal pressure, the lower flange having a lower flange first receiver and a lower flange last receiver, the lower flange first and last receivers being unitary with the lower flange, each flange receiver having a central axis, each flange receiver having a boss extending between a proximal end at the flange outer surface and a distal end, the lower flange first and last receivers each having a circular bore passing through the boss and in communication with the first and last tanks respectively;

an upper manifold, the upper manifold being disposed adjacent the upper flange, the upper manifold having a front wall, a rear wall, a first end wall, and a second end wall, the walls extending between inner and outer edges, the upper manifold having an outer plate extending between the front and rear walls and between the first and second end walls along the outer edges thereof, the upper manifold having a rim extending around the inner edges of the walls, the upper manifold having a plurality of chambers enclosed within the front and rear walls, the first and second end walls, and the outer plate, the chambers being disposed side-by-side in an array, each chamber corresponding to a respective heat transfer tank, each chamber being in communication with the adjacent chamber, each chamber being separated from the adjacent chamber by opposed front and rear channels, each front channel extending along the front wall between the inner and outer edges, each rear channel extending along the rear wall between the inner and outer edges, the upper manifold being connected to the secondary fluid coolant system, so as to convey the secondary fluid coolant between the secondary fluid coolant system and the heat transfer tanks, the upper manifold having an upper manifold first receiver and an upper manifold last receiver, the upper manifold first and last receivers being unitary with the upper manifold, each upper manifold receiver having a central axis, each upper manifold receiver having a boss extending between a proximal end at the upper manifold outer plate and a distal end, the upper manifold first and last receivers each having a circular bore passing through the boss and in communication with one of the chambers;

a lower manifold, the lower manifold being disposed adjacent the lower flange, the lower manifold having a front wall, a rear wall, a first end wall, and a second end wall, the walls extending between inner and outer edges, the lower manifold having an outer plate extending between the front and rear walls and between the first and second end walls along the outer edges thereof, the lower manifold having a rim extending around the inner edges of the walls, the lower manifold having a plurality of chambers enclosed within the front and rear walls, the first and second end walls, and the outer plate, the chambers being disposed side-by-side in an array, each chamber corresponding to a respective heat transfer tank, each chamber being in communication with the adjacent chamber, each chamber being separated from the adjacent chamber by opposed front and rear channels, each front channel extending along the front wall between the inner and outer edges, each rear channel extending along the rear wall between the inner and outer edges, the lower manifold being connected to the secondary fluid coolant system, so as to convey the secondary fluid coolant between the secondary fluid coolant system and the heat transfer tanks, the lower manifold having a lower manifold first receiver and a lower manifold last receiver, the lower manifold first and last receivers being unitary with the lower manifold, each lower manifold receiver having a central axis, each lower manifold receiver having a boss extending between a proximal end at the lower manifold outer plate and a distal end, the lower manifold first and last receivers each having a circular bore passing through the boss and in communication with one of the chambers;

an upper tube header having an outer periphery, and a lower tube header having an outer periphery, the upper and lower tube headers being spaced apart and generally parallel;

a plurality of generally straight and parallel tubes extending between the upper and lower tube headers, the tubes each having an outer surface and a bore, the tubes each having a tube wall extending between the outer surface and the bore, the tubes each having upper and lower open ends attached to and penetrating the upper and lower tube headers, respectively;

a plurality of tube bundles, wherein the upper tube header, the lower tube header, and the tubes comprise a tube bundle, each tube bundle being removably received within one of the heat transfer tanks, with the upper tube header being juxtaposed with the upper flange, and the lower tube header being juxtaposed with the lower flange;

a header O-ring juxtaposed between the header and the flange for sealing the upper and lower tube headers against leakage;

an upper seal extending around the upper manifold rim and juxtaposed between the upper manifold rim and the upper flange for sealing the upper manifold against leakage; and a lower seal extending around the lower manifold rim and juxtaposed between the lower manifold rim and the lower flange for sealing the lower manifold against leakage; so that the primary fluid coolant will flow from the primary fluid coolant system into the first distribution tank, the primary fluid coolant will pass through one of the flow gaps into the heat transfer tank, the primary fluid coolant will pass transversely across the outer surface of each of the tubes in the tube bundle, the primary fluid coolant will pass through another one of the flow gaps into the last distribution tank, and the primary fluid coolant will then flow from the last distribution tank into the primary fluid coolant system, and the secondary fluid coolant will flow from the secondary fluid coolant system into one of the upper and lower manifolds, the secondary fluid coolant will pass through the flange hole in the respective one of the upper and lower flanges, the secondary fluid coolant will pass through the bore of each of the tubes in the tube bundle, the secondary fluid coolant will pass through the flange hole in the other one of the upper and lower flanges, the secondary fluid coolant will flow into the other one of the upper and lower manifolds, and the secondary fluid coolant will then flow from the respective manifold into the secondary fluid coolant system, so as to allow heat to flow between the primary fluid coolant and the secondary fluid coolant through the tube walls.

28. The plastic heat exchanger of claim 27, further comprising at least one baffle removably received in a pair of the opposed front and rear channels, so as to selectively block communication between the respective adjacent chambers, and thereby control the flow of secondary fluid coolant.

29. The plastic heat exchanger of claim 27, wherein the header sealing means further comprises an upper seal plate and a lower seal plate, the upper seal plate being disposed against the upper flange outer surface, the lower seal plate being disposed against the lower flange outer surface, each seal plate extending between opposite first and second ends, and between opposite front and rear edges, each seal plate having an outer surface facing away from the shell, each seal plate having an inner surface facing toward the shell, each seal plate having a seal plate hole for each heat transfer tank, each seal plate hole extending through the seal plate from the outer surface to the inner surface, each seal plate hole being juxtaposed in collinear alignment with one of the flange holes, defining a hole pair, each hole pair having at least one annular recess, each hole pair receiving one of the tube headers therein, with the tube header outer periphery and the respective hole pair annular recess defining a header O-ring groove, the header O-ring being received in the header O-ring groove.

30. The plastic heat exchanger of claim 27, further comprising:

a flange first connector and a flange second connector, each flange connector having a central axis and a body extending between upper and lower ends, the body lower end having a pilot, the body upper end having a nozzle, the nozzle having an axis at an angle to the connector central axis of between zero and ninety degrees, each flange connector pilot being removably and rotatably received within one of the upper and lower flange receiver bores, each flange connector having a circular bore passing through the body and in communication with the respective flange receiver bore;

flange connector sealing means for rotatably sealing the flange first and second connectors to the flange receivers, so as to allow connection of the nozzles to the external conduits in any orientation; and retaining means for retaining the connector pilot in the receiver bore, while allowing selective rotation of the connector about the connector central axis.

31. The plastic heat exchanger of claim 30, further comprising:

at least one flange plug, each flange plug having a central axis and a body extending between upper and lower ends, the body lower end having a pilot, each flange plug pilot being adapted to be removably received within one of the upper and lower flange receiver bores, so as to selectively block the flow of primary fluid coolant;

flange plug sealing means for sealing the flange plug to the flange receiver; and retaining means for retaining the flange plug pilot in the receiver bore.

32. The plastic heat exchanger of claim 31, wherein:

the flange connector sealing means further comprises at least one flange connector O-ring sealingly juxtaposed between the flange connector pilot and the flange receiver bore; and the flange plug sealing means further comprises at least one flange plug O-ring sealingly juxtaposed between the flange plug pilot and the flange receiver bore.

33. The plastic heat exchanger of claim 27, further comprising:

a manifold first connector and a manifold second connector, each manifold connector having a central axis and a body extending between upper and lower ends, the body lower end having a pilot, the body upper end having a nozzle, the nozzle having an axis at an angle to the connector central axis of between zero and ninety degrees, each manifold connector pilot being removably and rotatably received within one of the upper and lower manifold receiver bores, each manifold connector having a circular bore passing through the body and in communication with the respective manifold receiver bore;

manifold connector sealing means for rotatably sealing the manifold first and second connectors to the manifold receivers, so as to allow connection of the nozzles to the external conduits in any orientation; and retaining means for retaining the connector pilot in the receiver bore, while allowing selective rotation of the connector about the connector central axis.

34. The plastic heat exchanger of claim 33, further comprising:

at least one manifold plug, each manifold plug having a central axis and a body extending between upper and lower ends, the body lower end having a pilot, each manifold plug pilot being adapted to be removably received within one of the upper and lower manifold receiver bores, so as to selectively block the flow of secondary fluid coolant;

manifold plug sealing means for sealing the manifold plug to the manifold receiver; and retaining means for retaining the manifold plug pilot in the receiver bore.

35. The plastic heat exchanger of claim 34, wherein:

the manifold connector sealing means further comprises at least one manifold connector O-ring sealingly juxtaposed between the manifold connector pilot and the manifold receiver bore; and the manifold plug sealing means further comprises at least one manifold plug O-ring sealingly juxtaposed between the manifold plug pilot and the manifold receiver bore.

36. The plastic heat exchanger of claim 27, further comprising a plurality of spacers, at least two spacers being disposed in each flow gap between a respective front and rear web adjacent the web upper and lower ends, so as to maintain the flow gaps in an open condition.

37. The plastic heat exchanger of claim 27, wherein:

the shell, manifolds, and flanges are constructed of a non-metallic corrosion resistant polymeric material selected from the group consisting of thermoset resins and thermoplastic resins; and the tubes are constructed of metal materials having efficient heat transfer properties selected from the group consisting of copper, bronze, stainless steel, and Monel.

* * * * *